US009881621B2

(12) United States Patent
Huang et al.

(10) Patent No.: US 9,881,621 B2
(45) Date of Patent: Jan. 30, 2018

(54) POSITION-DEPENDENT HYBRID DOMAIN PACKET LOSS CONCEALMENT

(71) Applicant: Dolby Laboratories Licensing Corporation, San Francisco, CA (US)

(72) Inventors: Shen Huang, Beijing (CN); Xuejing Sun, Beijing (CN)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/369,768

(22) Filed: Dec. 5, 2016

(65) Prior Publication Data

US 2017/0125022 A1 May 4, 2017

Related U.S. Application Data

(63) Continuation of application No. 14/431,256, filed as application No. PCT/US2013/062161 on Sep. 27, 2013, now Pat. No. 9,514,755.

(Continued)

(30) Foreign Application Priority Data

Sep. 28, 2012 (CN) ..... 2012 1 0371433

(51) Int. Cl.
*G10L 19/005* (2013.01)

(52) U.S. Cl.
CPC ..... *G10L 19/005* (2013.01)

(58) Field of Classification Search
USPC ..... 704/500–504
See application file for complete search history.

(56) References Cited

U.S. PATENT DOCUMENTS 6,636,565 B1 10/2003 Kim
6,775,649 B1 8/2004 Demartin (Continued)

FOREIGN PATENT DOCUMENTS

CN 101308660 * 11/2008 ..... G10L 19/02
EP 2270776 1/2011

(Continued)

OTHER PUBLICATIONS

Zhu et al.; Streaming Audio Packet Loss Concealment Based on Sinusoidal Frequency Estimation in MDCT Domain; IEEE Transactions on consumer Electronics; vol. 56, Issue: 2, pp. 811-819, Year: 2010.*

(Continued)

*Primary Examiner* — Abul Azad

(57) ABSTRACT

The present document relates to audio signal processing in general, and to the concealment of artifacts that results from loss of audio packets during audio transmission over a packet-switched network, in particular. A method (200) for concealing one or more consecutive lost packets (412, 413) is described. A lost packet (412) is a packet which is deemed to be lost by a transform-based audio decoder. Each of the one or more lost packets (412, 413) comprises a set of transform coefficients (313). A set of transform coefficients (313) is used by the transform-based audio decoder to generate a corresponding frame (412, 413) of a time domain audio signal. The method (200) comprises determining (205) for a current lost packet (412) of the one or more lost packets (412, 413) a number of preceding lost packets from the one or more lost packets (313); wherein the determined number is referred to as a loss position. Furthermore, the method comprises determining a packet loss concealment, referred to as PLC, scheme based on the loss position of the current packet; and determining (204, 207, 208) an estimate of a current frame (422) of the audio signal using the (Continued)

determined PLC scheme (204, 207, 208); wherein the current frame (422) corresponds to the current lost packet (412).

17 Claims, 8 Drawing Sheets

Related U.S. Application Data

(60) Provisional application No. 61/711,534, filed on Oct. 9, 2012.

(56) References Cited

U.S. PATENT DOCUMENTS

| | | | | |
|---|---|---|---|---|
| 6,985,856 | B2 | 1/2006 | Wang | |
| 7,031,926 | B2 | 4/2006 | Makinen | |
| 7,065,485 | B1 | 6/2006 | Chong-White | |
| 7,069,208 | B2 | 6/2006 | Wang | |
| 7,233,897 | B2 | 6/2007 | Kapilow | |
| 7,356,748 | B2 | 4/2008 | Taleb | |
| 7,359,409 | B2 | 4/2008 | Li | |
| 7,516,064 | B2 | 4/2009 | Vinton | |
| 7,552,048 | B2 | 6/2009 | Xu | |
| 7,627,467 | B2 | 12/2009 | Florencio | |
| 7,693,710 | B2 | 4/2010 | Jelinek | |
| 7,805,297 | B2 | 9/2010 | Chen | |
| 7,924,704 | B2 | 4/2011 | Dowdal | |
| 7,930,176 | B2 | 4/2011 | Chen | |
| 8,005,023 | B2 | 8/2011 | Li | |
| 8,015,000 | B2 | 9/2011 | Zopf | |
| 8,165,128 | B2 | 4/2012 | Sun | |
| 8,620,644 | B2 * | 12/2013 | Ryu | G10L 19/005 704/201 |
| 8,831,959 | B2 * | 9/2014 | Grancharov | G10L 19/02 341/55 |
| 8,843,798 | B2 | 9/2014 | Sung | |
| 9,053,699 | B2 | 6/2015 | Mittal | |
| 2003/0009325 | A1 | 1/2003 | Kirchherr | |
| 2004/0128128 | A1 | 7/2004 | Wang | |
| 2007/0064812 | A1 | 3/2007 | Baik | |
| 2007/0094009 | A1 | 4/2007 | Ryu | |
| 2008/0126096 | A1 * | 5/2008 | Oh | G10L 19/005 704/265 |
| 2008/0126904 | A1 | 5/2008 | Sung | |
| 2008/0232478 | A1 | 9/2008 | Teng | |
| 2009/0279615 | A1 | 11/2009 | Au | |
| 2010/0115370 | A1 | 5/2010 | Laaksonen | |
| 2011/0044323 | A1 | 2/2011 | Zhan | |
| 2011/0125505 | A1 | 5/2011 | Vaillancourt | |
| 2011/0191111 | A1 | 8/2011 | Chu | |
| 2011/0196673 | A1 | 8/2011 | Sharma | |
| 2012/0101814 | A1 | 4/2012 | Elias | |

FOREIGN PATENT DOCUMENTS

| | | |
|---|---|---|
| EP | 2360682 | 8/2011 |
| WO | 2008/074249 | 6/2008 |
| WO | 2011/158485 | 12/2011 |

OTHER PUBLICATIONS

Elsabrouty, M. et al "A New Hybrid Long-Term and Short-Term Prediction Algorithm for Packet Loss Erasure over IP-Networks" Seventh International Symposium on Signal Processing and Its Applications, Jul. 1-4, 2003, pp. 361-364, vol. 1, published by IEEE.

ITU-T Recommendation G.711 Appendix I, "A High Quality Low Complexity Algorithm for Packet Loss Concealment with G.711", Sep. 1999.

ITU-T Recommendation G.722 "Appendix III: A High-Quality Packet Loss Concealment Algorithm for G.722", Nov. 2006.

Kondo, K. et al "A Speech Packet Loss Concealment Method Using Linear Prediction" IEICE Transactions on Information and Systems, vol. E89-D, No. 2, pp. 806-813, publication date: Feb. 1, 2006.

Ofir, H. et al "Audio Packet Loss Concealment in a Combined MDCT-MDST Domain" IEEE Signal Processing Letters, vol. 14, Issue 12, pp. 1032-1035, Dec. 2007.

Perkins, C. et al "A Survey of Packet Loss Recovery Techniques for Streaming Audio" IEEE Network, vol. 12, No. 5, pp. 40-48, Sep.-Oct. 1998.

Sakai, T. et al "Packet Loss Concealment for Online MP3 Music Delivery" Record of Electrical and Communication Engineering Conversazione Tohoku University, vol. 76, No. 1, pp. 238-239, 2008.

Vilaysouk, V. et al "A Hybrid Concealment Algorithm for Non-Predictive Wideband Audio Coders" AES presented at the 120th convention, Paris, France, May 20-23, 2006.

* cited by examiner

POSITION-DEPENDENT HYBRID DOMAIN PACKET LOSS CONCEALMENT

TECHNICAL FIELD OF THE INVENTION

The present document relates to audio signal processing in general, and to the concealment of artifacts that result from loss of audio packets during audio transmission over a packet-switched network, in particular.

BACKGROUND OF THE INVENTION

Packet loss occurs frequently in VoIP or wireless voice communication systems. Lost packets result in clicks or pops or other artifacts that greatly degrade the perceived speech quality at the receiver side. To combat the adverse impact of packet loss, packet loss concealment (PLC) algorithms, also known as frame erasure concealment algorithms, have been described. Such algorithms normally operate at the receiver side by generating a synthetic audio signal to cover missing data (erasures) in a received bit stream. Among various PLC methods, time domain pitch-based waveform substitution, such as G.711 Appendix I (ITU-T Recommendation G.711 Appendix I, "A high quality low complexity algorithm for packet loss concealment with G.711," 1999, which is incorporated by reference), may be used. However, these approaches degrade audio quality notably in the event of consecutive packet loss, often generating artifacts due to the repetition of similar content over several frames or due to low signal periodicity.

PLC in the time domain typically cannot be directly applied to decoded speech which has been determined from a transform domain codec due to an extra aliasing buffer. For this purpose, PLC schemes in the transform domain, e.g. in the MDCT domain, have been described. However, such schemes may cause "robotic" sounding artifacts and may lead to rapid quality degradation, notably if PLC is used for a plurality of lost packets.

Therefore, there is a need to improve audio quality by mitigating artifacts through advanced PLC algorithms used in conjunction with transform domain codecs.

SUMMARY OF THE INVENTION

According to an aspect a method for concealing one or more consecutive lost packets is described. Typically, a lost packet is a packet which is deemed to be lost by a transform-based audio decoder. Each of the one or more lost packets comprises a set of transform coefficients. In other words, the transform-based audio decoder expects each of the one or more lost packets to comprise a respective set of transform coefficients. Each of the sets of transform coefficients (if received) is used by the transform-based audio decoder to generate a corresponding frame of a time domain audio signal.

The transform-based audio decoder may apply an overlapped transform (e.g. a modified discrete cosine transform (MDCT) followed by an overlap-add operation). Each set of transform coefficients may comprises N transform coefficients, with N>1 (e.g. N=320 or N=1028). For each set of transform coefficients, the overlapped transform may generate a corresponding aliased intermediate frame of 2N samples. For each received packet, the overlapped transform may generate the corresponding frame of the time domain audio signal, based on a first half of the corresponding aliased intermediate frame and based on a second half of the aliased intermediate frame of a packet which precedes the received packet (using the overlap-add operation e.g. in conjunction with a fade-in window for the first half of the corresponding aliased intermediate frame and a fade-out window for the second half of the aliased intermediate frame of a packet which precedes the received packet). In an embodiment, the transform-based audio decoder is a modified discrete cosine transform (MDCT) based audio decoder (e.g. an AAC decoder) and the set of transform coefficients is a set of MDCT coefficients.

The method may comprise determining for a current lost packet of the one or more lost packets a number of preceding lost packets from the one or more lost packets. The determined number may be referred to as the loss position of the current lost packet. By way of example, the current lost packet may be the first lost packet, i.e. loss position equal to one, (such that the current lost packet is directly preceded by a last received packet) or the current lost packet may be the second lost packet, i.e. loss position equal to two, (such that the current lost packet is directly preceded by a lost packet itself).

The method may further comprise determining a packet loss concealment (PLC) scheme based on the loss position of the current packet. In particular, the PLC scheme may be determined from a set of pre-determined PLC schemes. The set of pre-determined PLC schemes may comprise one or more of: a so-called time domain PLC scheme (including various variants thereof) or a so-called de-correlated PLC scheme. By way of example, the method may select a different PLC scheme for the first loss position (i.e. when the current lost packet is the first lost packet) than for the second loss position (i.e. when the current lost packet is the second lost packet).

In addition, the method may comprise determining an estimate of a current frame of the audio signal using the determined PLC scheme. The current frame typically corresponds to the current lost packet, i.e. the current frame is typically the frame of the time domain audio signal that would have been generated based on the current lost packet, if the current lost packet had been received by the audio decoder.

For determining the estimate of the current frame, the method may determine a plurality of buffers comprising different sets of samples. In particular, the method may comprise determining a last received packet comprising a last received set of transform coefficients. The last received packet is typically the packet which directly precedes the one or more lost packets. Furthermore, the method may comprise determining a first buffer based on a last received frame of the time domain audio signal, wherein the last received frame corresponds to the last received packet, i.e. wherein the last received frame has been generated using the set of transform coefficients of the last received packet (and the set of transform coefficients of the packet which directly precedes the last received packet). Typically, the last received frame is the last frame which has been correctly decoded by the transform based audio decoder. The first buffer may comprise the N samples of the last received frame. The first buffer is also referred to in the present document as the "previously decoded buffer".

The method may further comprise determining a second buffer based on the second half of the aliased intermediate frame of the last received packet. As indicated above, the audio decoder may be configured to generate an intermediate frame comprising 2N samples from the set of transform coefficients. The 2N samples may be grouped into a first half (comprising N samples, e.g. from n=0, . . . , N−1) and a succeeding second half (comprising N samples, e.g. from n=N, . . . , 2N−1). As such, the second half of the aliased intermediate frame may comprise the N samples ranging from n=N, . . . , 2N−1. The second buffer may comprise these N samples of the second half of the aliased intermediate frame of the last received packet. It can be shown that the second half of the aliased intermediate frame comprises aliased information regarding the frame of the audio signal which directly succeeds the last received frame. As such, the second buffer comprises (aliased) information regarding the frame of the audio signal which directly succeeds the last received frame. It is proposed in the present document to make use of this most recent information for concealing one or more lost packets. The second buffer is also referred to herein as the "temporal IMDCT buffer".

The method may further comprise determining a diffused set of transform coefficients based on the set of transform coefficients of the last received packet. This may be achieved by low pass filtering the absolute values of the set of transform coefficients of the last received packet and/or by randomizing some or all of the signs of the set of transform coefficients of the last received packet. Typically, only the signs of the transform coefficients which have an energy at or below an energy threshold $T_e$ are randomized, while the signs of the transform coefficients which have an energy above the energy threshold $T_e$ are maintained. Furthermore, the method may comprise determining a diffused aliased intermediate frame based on the diffused set of transform coefficients. This may be achieved by applying an inverse transform (e.g. an IMDCT) to the diffused set of transform coefficients. The method may comprise determining a third buffer based on the diffused aliased intermediate frame. In particular, the third buffer may comprise the first half of the diffused aliased intermediate frame. The third buffer may be referred to herein as the "temporal de-correlated IMDCT buffer". As such, the third buffer comprises diffused or de-correlated information regarding the last-received packet. It is proposed in the present document to make use of such diffused information, in order to reduce audible artifacts (e.g. "buzz" or "robotic" artifacts) when concealing the one or more lost packets.

The method may further comprise determining a pitch period W based on the first buffer and/or based on the second buffer. The pitch period W may be determined by computing a Normalized Cross Correlation (or just cross correlation) function NCC (lag) based on the first buffer and/or based on the second buffer. A lag value which maximizes the Normalized Cross Correlation function NCC (lag) within a pre-determined lag interval (typically excluding lag=0) may be indicative of the pitch period W. In particular, the pitch period W may correspond to (or may be equal to) the lag value which maximizes the correlation function NCC(lag). In an embodiment, the correlation function NCC(lag) is determined based on concatenation of the first buffer and the second buffer. As such, the pitch period W is determined based on the most recent available information (including information on the frame succeeding the last received frame, comprised within the second buffer), thereby improving the estimate of the pitch period W. As such, the present document also discloses a method for estimating a pitch period W based on the first buffer and based on the second buffer.

Furthermore, the method may comprise determining a confidence measure CVM based on the correlation function NCC(lag). The confidence measure CVM is typically indicative of a degree of periodicity within the last received frame. The confidence measure CVM may be determined based on a maximum of the correlation function NCC(lag) and/or based on whether the packet directly preceding the last received packet is deemed to be lost.

The confidence measure CVM may be used to determine the PLC scheme which is used to determine the estimate of the current frame. In particular, the method may comprise determining that the confidence measure CVM is greater than a pre-determined confidence threshold $T_c$. In such cases, a variant of the time domain PLC scheme may be selected as the determined PLC scheme. In a similar manner, the method may comprise determining that the confidence measure CVM is equal to or smaller than a pre-determined confidence threshold $T_c$. Furthermore, it may be determined that the current packet is the first lost packet subsequent to the last received packet. In such cases, the de-correlated PLC scheme may be selected as the determined PLC scheme.

Determining the estimate of the current frame using the de-correlated PLC scheme may comprise cross-fading the second half of the aliased intermediate frame (comprised within the second buffer) and the first half of the diffused aliased intermediate frame (comprised within the third buffer) using a fade-out window and a fade-in window, respectively. In other words, the second half of the aliased intermediate frame (subjected to a fade-out window) and the first half of the diffused aliased intermediate frame (subjected to a fade-in window) may be combined in an overlap-add operation. The estimate of the current frame may be determined based on the resulting (overlap-added) frame. As a result of combining the second half of the aliased intermediate frame with a diffused version of the first half of the aliased intermediate frame of the last received packet, a good estimate of the current frame can be obtained, in cases where the last received frame has a relatively low degree of periodicity.

Determining the estimate of the current frame using (a variant of) the time domain PLC scheme may comprise determining a pitch period buffer based on the samples of the one or more last received frames (stored in the first buffer) and/or the samples of the aliased intermediate frame (stored in the second buffer). The pitch period buffer typically has a length corresponding to the pitch period W. Furthermore, the method may comprise determining a periodical waveform extrapolation (PWE) component by concatenation of one or more pitch period buffers. Typically, the PWE component is obtained by concatenating N/W pitch period buffers (i.e. possibly also a fraction of a pitch period buffer, in this case, an offset is stored and concealment will be performed in the following frames), such that the PWE component comprises N samples. In cases where W>N only a fraction of the pitch period buffer may be used. The estimate of the current frame may be determined based on the PWE component. The determination of the PWE component may be in accordance to the concealment scheme described in the ITU-T G.711 standard. The determination of a PWE component may be beneficial in cases where the last received frame comprises a relatively high degree of periodicity, wherein the periodicity may be reflected within the PWE component (due to the concatenation of a plurality of pitch period buffers).

Determining the estimate of the current frame using the time domain PLC scheme may further comprise determining an aliased component based on the second half of the aliased intermediate signal (stored in the second buffer). As indicated above, the second buffer comprises the most recent (aliased) information regarding the frame following the last received frame. As such, it is proposed in the present document to determine the estimate of the current frame also based on the aliased component, thereby improving the quality of the estimate of the current frame. In particular, the estimate of the current frame may be determined by cross-fading the aliased component and the PWE component using a first and second window, respectively. The first window may be a fade-out window (fading out the aliased component) and the second window may be a fade-in window (fading in the PWE component). In particular, this may be the case if the current lost packet is the first lost packet. In such cases, it is ensured that the aliased component is phase aligned with the last received frame. By fading-out the aliased component and at the same time by fading-in the PWE component, it can be ensured that the estimate of the current frame is phase aligned with the (directly preceding) last received frame (due to a fade-in of the PWE component), and that the impact of aliasing on the estimate of the current frame is reduced (due to a fade-out of the aliased component).

Hence, the present document describes a method for concealing a lost packet based on the first buffer and based on the second buffer. In particular, the present document describes a method for concealing a lost packet based on the PWE component and based on the aliased component.

The phase alignment of the aliased component with the frame preceding the current frame may not be assured in cases, where the current lost packet is not the first lost packet. In such cases, the phase of the frame preceding the current frame is typically given by the PWE component which was used to determine the estimate of the frame preceding the current frame. If it is ensured that the PWE component for the current frame is phase aligned with the PWE component of the frame preceding the current frame, a phase alignment of the aliased component may be achieved by determining a phase position of the PWE component for the current frame and by aligning a phase of the aliased component to the determined phase position of the PWE component for the current frame. This phase alignment may be achieved by omitting one or more samples from the second half of the aliased intermediate frame. Typically, one or more samples at the beginning of the second half of the aliased intermediate frame are omitted, thereby yielding a shortened aliased intermediate frame. The aliased component for the current frame may be determined by using the shortened aliased intermediate frame with zeros appended to the end to yield N samples.

As such, a plurality of lost packets may be concealed, i.e. a plurality of estimates for the frames corresponding to the plurality of lost packets may be determined, based on a respective plurality of PWE components and a plurality of aliased components. The plurality of estimates of the concealed frames may exhibit a relatively high degree of periodicity which exceeds the periodicity of the actually lost frames. This may lead to undesirable artifacts such as "buzz" or "robotic" artifacts. In the present document, it is proposed to make use of a further diffused component to reduce such artifacts. Hence, the present document describes a method for reducing audible artifacts when concealing a plurality of lost packets, by using a diffused component.

Determining the estimate of the current frame using the time domain PLC scheme may comprise determining a diffused last received frame based on the first half of the diffused intermediate frame (stored in the third buffer). In particular, the diffused last received frame may be determined based on an overlap-add operation applied to the first half of the diffused intermediate frame and the second half of the intermediate frame of the packet directly preceding the last received packet. The diffused component may be determined in a similar manner to the PWE component (wherein the samples of the last received frame are replaced by the samples of the diffused last received frame). Hence, the method may comprise determining a diffused pitch period buffer based on the samples of the diffused last received frame. Typically, the diffused pitch period buffer has a length corresponding to the pitch period W. The diffused component may be determined by concatenation of one or more diffused pitch period buffers (to yield a diffused component having N samples). In the present document, it is proposed to determine the estimate of the current frame also based on the diffused component, thereby reducing artifact, notably in cases where a relatively high number of lost packets are to be concealed (e.g. 2, 3 or more lost packets).

In particular, determining the estimate of the current frame using the time domain PLC scheme may comprise applying a third window to the PWE component, applying a fourth window to the aliased component, and applying a fifth window to the diffused component. The estimate of the current frame may be determined based on the windowed PWE, the windowed aliased and the windowed diffused components. This may be the case for current frames with a loss position of greater than one, i.e. in cases where the current lost packet is the second or later lost packet.

By way of example, the current lost packet may be directly preceded by a previous lost packet. If for the previous lost packet the third window is a fade-in window, then for the current lost packet the third window may be a fade-out window, and vice versa. Furthermore, if for the previous lost packet the fifth window is a fade-out window, then for the current lost packet the fifth window may be a fade-in window, and vice versa. In addition, if for the current lost packet the fifth window is a fade-in window, the third window may be a fade-out window, and vice versa. In particular, the fade-in window used as the third window may be the same fade-in window as used for the fifth window. In a similar manner, the fade-out window used as the third window may be the same fade-out window as used for the fifth window. The above conditions specify an alternating use of the PWE component and the diffused component. By doing this, it can be ensured that succeeding estimates of frames are phase aligned and that succeeding estimates of frames are diversified, thereby reducing "buzz" and/or "robotic" artifacts. The fourth window (used for the aliased component) may be a convex combined fade-in/fade-out window.

The method may further comprise applying a long-term attenuation to the estimate of the current frame, wherein the long-term attenuation depends on the loss position. Typically, the long-term attenuation increases with increasing loss position. As such, the long-term attenuation may provide for a fade-out of the estimates of frames (corresponding to lost packets) across a plurality of lost packets, thereby providing a smooth transition from concealment to silence (if the number of lost packets exceeds a maximum allowed number of lost packets).

The method may further comprise, if the current lost packet is the first lost packet, cross-fading a frame derived using a particular determined PLC scheme with the second half of the aliased intermediate frame (stored in the second buffer) to yield the estimate of the current frame, or if the current packet is the first received packet after packet loss, cross-fading a frame derived from a determined PLC scheme with the first half of the second buffer transformed by that received packet. On the other hand, if the current lost packet is not the first lost packet, the frame derived using the determined PLC scheme may be taken as the estimate of the current frame. This selective use of cross-fading is referred to as hybrid reconstruction in the present document.

According to another aspect, a system configured to conceal one or more consecutive lost packets is described. A lost packet may be a packet which is deemed to be lost by a transform-based audio decoder. Each of the one or more lost packets may comprise a set of transform coefficients, wherein a set of transform coefficients is used by the transform-based audio decoder to generate a corresponding frame of a time domain audio signal. The system may comprise a lost position detector configured to determine for a current lost packet of the one or more lost packets a number of preceding lost packets from the one or more lost packets. The determined number may be referred to as the loss position. Furthermore, the system may comprise a decision unit configured to determine a packet loss concealment (PLC) scheme based on the loss position of the current packet. In addition, the system may comprise a PLC unit configured to determine an estimate of a current frame of the audio signal using the determined PLC scheme. The current frame typically corresponds to the current lost packet.

According to a further aspect, a method (and a corresponding system) for concealing one or more consecutive lost packets is described. A lost packet typically is a packet which is deemed to be lost by a transform-based audio decoder. Each of the one or more lost packets typically comprises a set of transform coefficients. A set of transform coefficients may be used by the transform-based audio decoder to generate a corresponding frame of a time domain audio signal. The transform-based audio decoder may apply an overlapped transform. If a set of transform coefficients comprises N transform coefficients, with N>1, the overlapped transform may generate for each set of transform coefficients a corresponding aliased intermediate frame of 2N samples. For each received packet, the overlapped transform may generate the corresponding frame of the audio signal, based on a first half of the corresponding aliased intermediate frame and based on a second half of the aliased intermediate frame of a packet which precedes the received packet. The method may comprise determining a last received packet comprising a last received set of transform coefficients; wherein the last received packet is directly preceding the one or more lost packets. Furthermore, the method may comprise determining a first buffer based on a last received frame of the audio signal; wherein the last received frame corresponds to the last received packet. In addition, the method may comprise determining a second buffer based on the second half of the aliased intermediate frame of the last received packet. An estimate of a current frame of the audio signal may be determined using the first buffer and the second buffer, wherein the current frame corresponds to the current lost packet.

According to another aspect, a method (and a corresponding system) for concealing one or more consecutive lost packets is described. A lost packet may be a packet which is deemed to be lost by a transform-based audio decoder. Each of the one or more lost packets may comprise a set of transform coefficients, wherein a set of transform coefficients is used by the transform-based audio decoder to generate a corresponding frame of a time domain audio signal. The method may comprise determining a diffused set of transform coefficients based on the set of transform coefficients of a last received packet. Furthermore, the method may comprise determining a diffused aliased intermediate frame based on the diffused set of transform coefficients using an inverse transform. In addition, the method may comprise determining a third buffer based on the diffused aliased intermediate frame. An estimate of a current frame of the audio signal may be determined using the third buffer. Typically, the current frame corresponds to the current lost packet.

According to a further aspect, a software program is described. The software program may be adapted for execution on a processor and for performing the method steps outlined in the present document when carried out on the processor.

According to another aspect, a storage medium is described. The storage medium may comprise a software program adapted for execution on a processor and for performing the method steps outlined in the present document when carried out on the processor.

According to a further aspect, a computer program product is described. The computer program may comprise executable instructions for performing the method steps outlined in the present document when executed on a computer.

It should be noted that the methods and systems including its preferred embodiments as outlined in the present patent application may be used stand-alone or in combination with the other methods and systems disclosed in this document. Furthermore, all aspects of the methods and systems outlined in the present patent application may be arbitrarily combined. In particular, the features of the claims may be combined with one another in an arbitrary manner.

SHORT DESCRIPTION OF THE FIGURES

The invention is explained below in an exemplary manner with reference to the accompanying drawings, wherein FIG. 1 shows a block diagram of an example packet loss concealment system;

Figure 7:
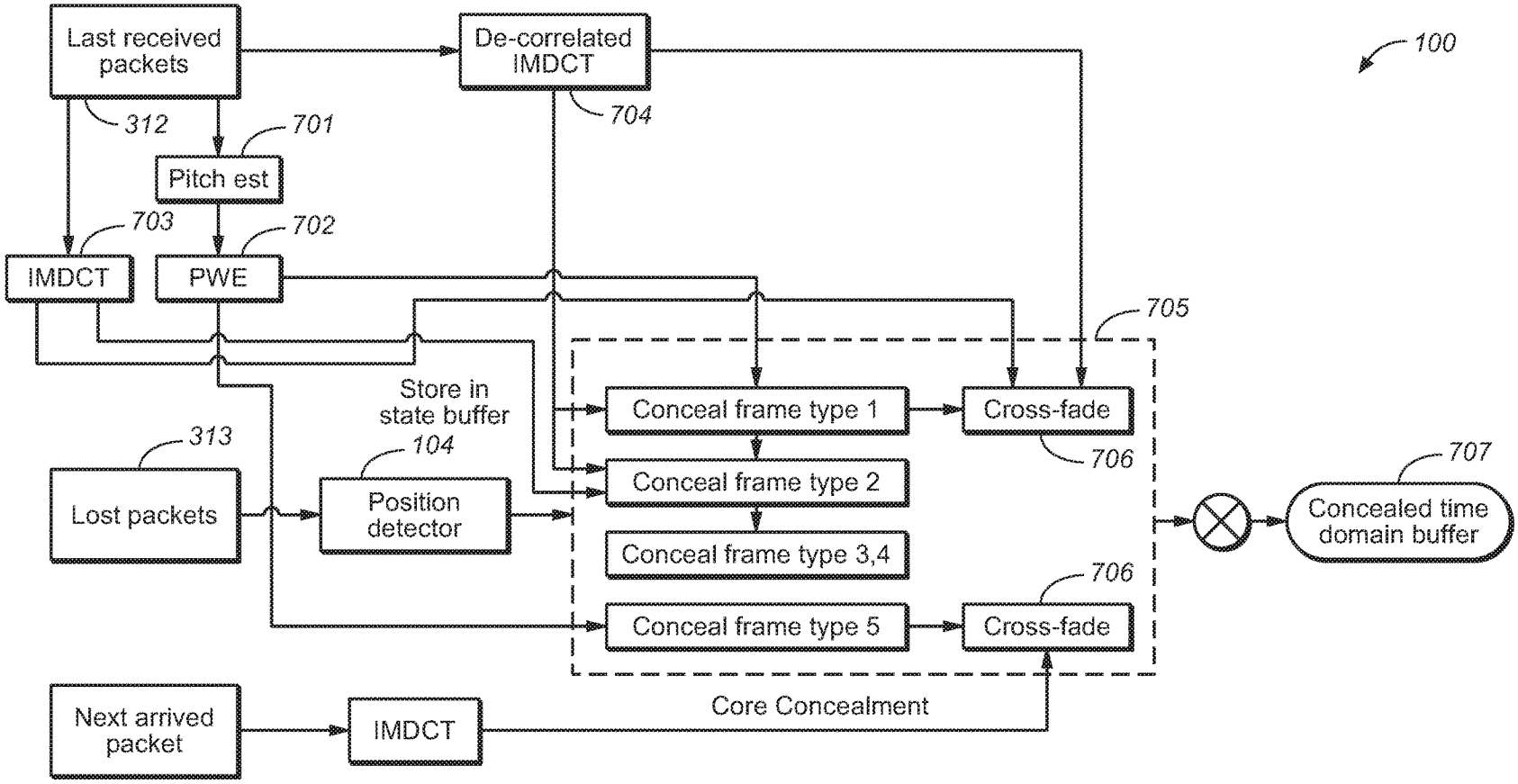

FIGS. 6A, 6B, 6C, and 6D illustrate example aspects of a time domain PLC scheme;

FIG. 7 shows a block diagram of components of an example PLC system; and

Figures 8A, 8B:
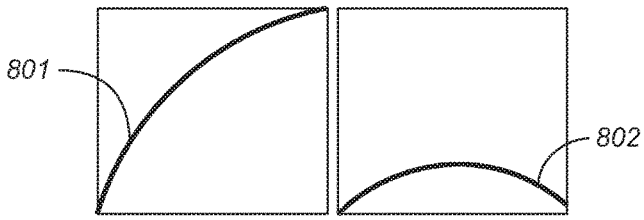

FIGS. 8A and 8B illustrate the impact of double windowing during hybrid reconstruction.

DETAILED DESCRIPTION OF THE INVENTION

As outlined in the background section, PLC schemes tend to insert artifacts into a concealed audio signal, notably for an increasing number of consecutively lost packets. In the present document, various measures for improving PLC are described. These measures are described in the context of an overall PLC system 100 (see FIG. 1). It should be noted, however, that these measure may be used standalone or in arbitrary combination with one another.

The PLC system 100 will be described in the context of a MDCT based audio encoder, such as e.g. an AAC (Advanced Audio Coder). It should be noted, however, that the PLC system 100 is also applicable in conjunction with other transform-based audio codecs and/or other time domain to frequency domain transforms (in particular to other overlapped transforms).

In the following, an AAC encoder is described in further detail. The AAC core encoder typically breaks an audio signal 302 (see FIG. 3) into a sequence of segments 303, called frames. A time domain filter, called a window, provides smooth transitions from frame to frame by modifying the data in these frames. The AAC encoder may use different time-frequency resolutions: e.g. a first resolution, referred to as a long-block, encoding an entire frame of N=1028 samples and a second resolution, referred to as a short-block, encoding a plurality of segments of N=128 samples of the frame. As such, the AAC encoder may be adapted to encode audio signals that vacillate between tonal (steady-state, harmonically rich complex spectra signals) (using a long-block) and impulsive (transient signals) (using a sequence of eight short-blocks).

Figure 3:
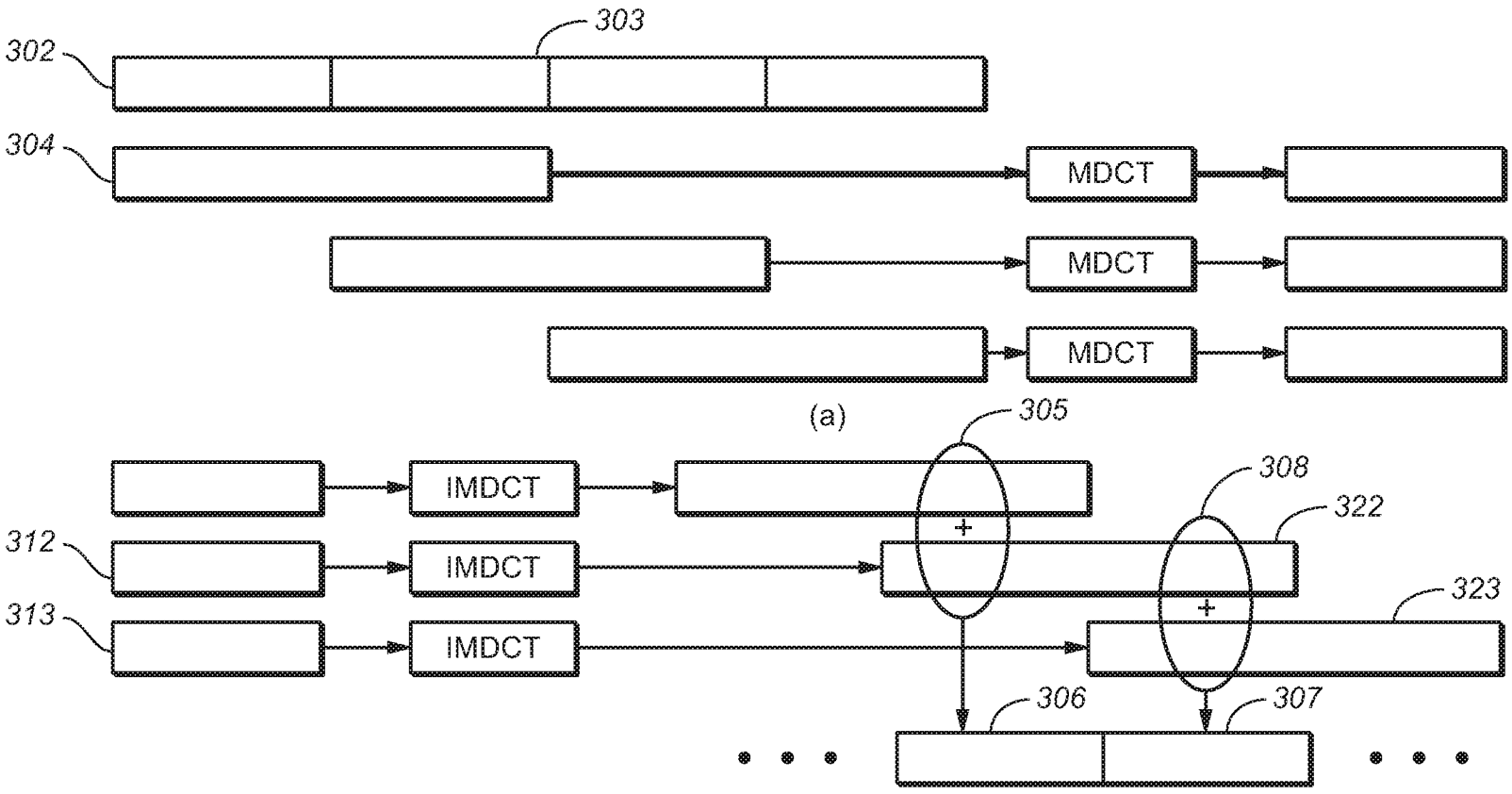
FIG. 3 illustrates example aspects of an overlapped transform encoder and decoder.

Each block of samples (i.e. a short-block or a long-block) is converted into the frequency domain using a Modified Discrete Cosine Transform (MDCT). In order to circumvent the problem of spectral leakage, which typically occurs in the context of block-based (also referred to as frame-based) time frequency transformations, MDCT makes use of overlapping windows, i.e. MDCT is an example of a so-called overlapped transform. This is illustrated in FIG. 3 for the case of a long-block, i.e. for the case where an entire frame is transformed. FIG. 3 shows an audio signal 302 comprising a sequence of frames 303. In the illustrated example, each frame 303 comprises N samples of the audio signals 302. Instead of applying the transform to only a single frame, the overlapping MDCT transforms two neighboring frames in an overlapping manner, as illustrated by the sequence 304. To further smoothen the transition between sequential frames, a window function w[k] (or h[n]) of length 2N is additionally applied. It should be noted that because the window w[k] is applied twice, i.e. in the context of the transform at the encoder and in the context of the inverse transform at the decoder, the window function w[k] should fulfill the Princen-Bradley condition. As a result of the windowing and the transform, a sequence of sets of frequency coefficients (also referred to as transform coefficients) of length N is obtained. At the corresponding AAC decoder, the inverse MDCT is applied to the sequence of sets of frequency coefficients, thereby yielding a sequence of frames of time-domain samples with a length of 2N (these frames of 2N samples are referred to as aliased intermediate frames in the present document). Using an overlap and add operation 305 (under consideration of the window function w[k]) as illustrated in FIG. 3, the frames of decoded samples 306 of length N are obtained. As such, a packet comprising the set of frequency coefficients 312 is used to generate a corresponding frame 306 of the time domain audio signal. In the present document, the frame 306 is referred to as the frame of the decoded time domain audio signal, which "corresponds" to the set of frequency coefficients 312 (or which "corresponds" to the packet comprising the set of frequency coefficients 312).

It may occur that one or more packets are lost (or are deemed to be lost) at the decoder. Each packet typically comprises a set of frequency coefficients (i.e. a set of MDCT coefficients). In order to generate the frames 306 of decoded samples, the decoder has to reconstruct the lost packets (i.e. the lost sets of frequency coefficients) from previously received data. This task is referred to as Packet Loss Concealment (PLC).

As indicated above, the present document describes a PLC system 100. In particular, the present document describes a position-dependent hybrid PLC scheme for MDCT based voice codecs. It should be noted that the PLC scheme is also applicable to other transform based audio codecs. It is proposed in the present document to make the PLC processing dependent on the position of a lost packet, i.e. on the number of consecutive lost packets which precede a packet that is to be concealed.

Alternatively or in addition, it is proposed to make use of and to maintain several signal buffers generated via different signal processing techniques. These buffers (see FIG. 1) may comprise one or more of:

(1) a previously decoded buffer 102 for previously fully reconstructed signals. This buffer 102 is also referred to as the "first buffer". This buffer comprises one or more of the most recent audio frames 306 which have been reconstructed based on completely received MDCT packets.

(2) a temporal IMDCT buffer 103. This buffer 103 is also referred to as the "second buffer". This buffer 103 comprises half of the time domain signal 322 before overlap-add decoded from the last received packet. This is illustrated in FIG. 3. If it is assumed that the packet 313 (i.e. the set 313 of MDCT coefficients) is lost, then the packet 312 is the last received packet. The last received packet 312 is transformed into the time domain using the IMDCT transform, thereby yielding the aliased intermediate signal (or frame) 322 (before overlap and add). The first half of the aliased intermediate signal 322 is used to generate the decoded frame 306 (which is stored in the first buffer 102). On the other hand, the second half of the aliased intermediate signal 322 is stored in the temporal IMDCT buffer 103 (i.e. in the second buffer 103).

(3) a temporal de-correlated IMDCT buffer 109. This buffer 109 is also referred to as the "third buffer". This buffer 109 is used to store one or more frames of a decoded signal, decoded from the last received packet 312, wherein the decoding has been performed using MDCT domain de-correlation (as will be outlined later).

Different signals from these buffers may be selected according to the loss position and/or according to the reliability of the signal buffers. By way of example, for the first lost packet, a de-correlated IMDCT signal may be used, which is more efficient and stable than a conventional pitch based time domain solution. For other loss positions, pitch based time domain concealment may be applied. However, such time domain concealment may occasionally fail and generate audible distortions due to low periodicity of the signal (e.g. fricative, plosive, etc) or due to particular loss patterns (e.g. interleaved loss of packets). Therefore, it is proposed in the present document to construct a robust base pitch buffer by using a loss position based hybrid solution. By way of example, for the first lost frame, a voicing confidence measure (CVM) may be derived from the information of the previously decoded buffer 102 and/or the temporal IMDCT buffer 103. This confidence measure CVM may be used to decide whether the more stable de-correlated IMDCT buffer 109 will be used instead of a time domain PLC to conceal the first lost packet.

Figure 1:
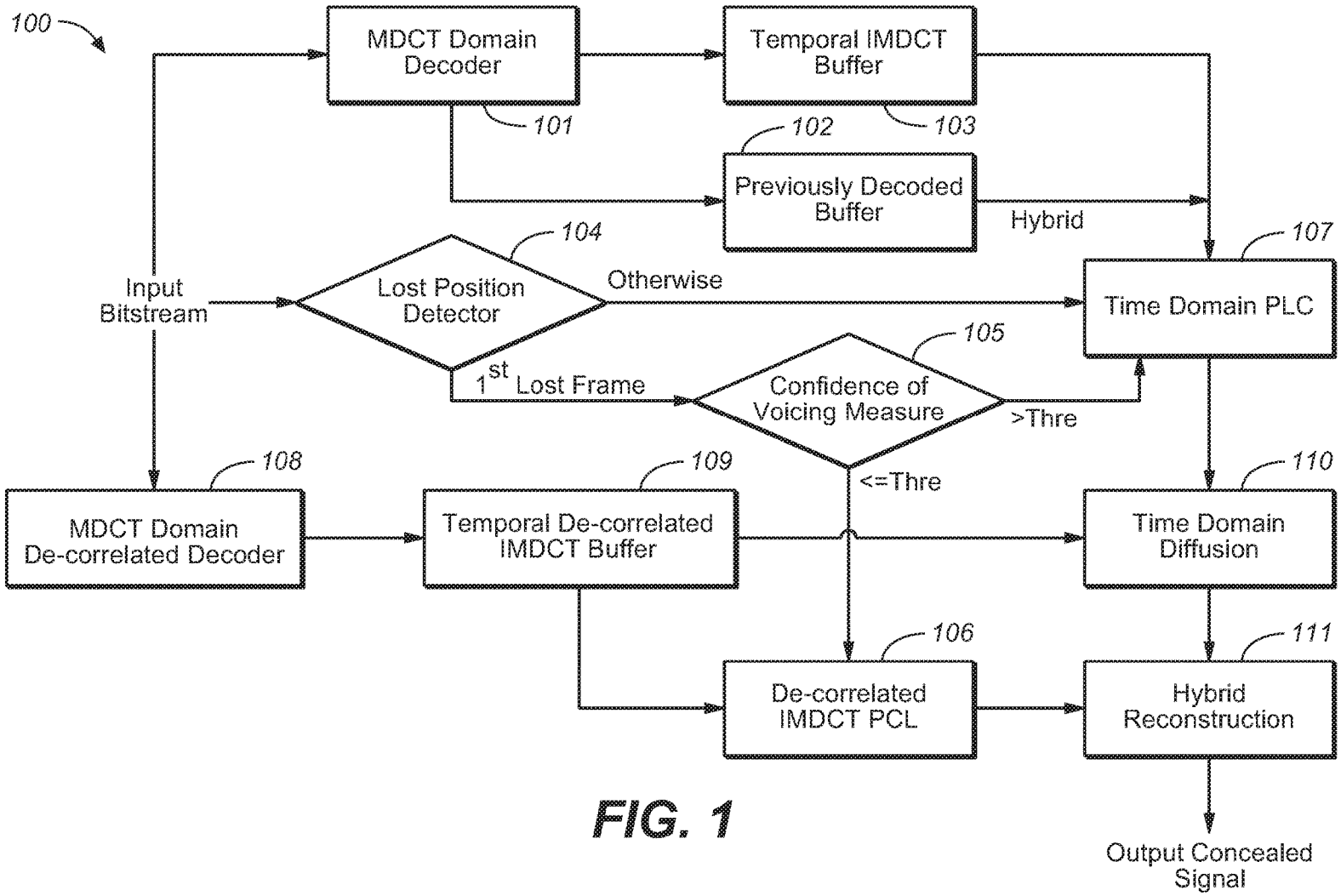

In the illustrated example of FIG. 1, the time domain PLC unit 107, instead of operating independently, fully takes the advantages of the MDCT domain output according to the specific loss position. Furthermore, in order to minimize "buzz" sounding artifacts, a novel diffusion algorithm is described (Time Domain Diffusion Unit 110). In addition, hybrid reconstruction is proposed depending on the domain chosen and/or depending on the loss position.

FIG. 1 illustrates an example PLC system 100. It can be seen that the proposed system comprises one or more of the following elements:

An MDCT domain decoder 101 may be applied for generating the one or more time domain frames which may be stored in the previously decoded buffer 102. The frame(s) in buffer 102 are alias cancelled and may be used for generating a base pitch buffer and a confidence voicing measure (CVM). Furthermore, the MDCT domain decoder 101 may be used to determine the one or more time domain aliased intermediate signals (also referred to aliased intermediate frames) stored in the temporal IMDCT buffer. The intermediate signal(s) may be used for the extrapolation of concealed speech in conjunction with the main PWE (Periodic Waveform Extrapolation) stream. In addition, the decoder 101 (or a specific decoder 108) may be used to determine time domain signals to be stored in the temporal de-correlated IMDCT buffer 109. The information stored in buffer 109 may be used by the de-correlated IMDCT PLC unit 106 and by the time domain diffusion unit 110;

A lost position detector 104 may be configured to determine the number of consecutive lost frames (or packets). As such, the lost position detector 104 may determine the loss position of a current frame (or packet). If the current frame is detected to be the first lost frame (or the current packet is determined to be the first lost packet), then a confidence of voicing measure CVM 105 may be computed using the previously decoded buffer 102 and/or the temporal IMDCT buffer 103. If the CVM is at or below a pre-determined confidence threshold, de-correlated IMDCT PLC 106, which is derived from the temporal diffused IMDCT buffer 109 decoded by a parallel MDCT domain decoder 108, may be applied. This tends to create an output with less audible artifacts (in cases where there is a low confidence in the voicing of the audio signal). This output may also be used to fill the base pitch buffer for future concealment (i.e. to generate a diffused base pitch buffer and a diffused component for concealment using time domain PLC). A CVM above the pre-determined confidence threshold may trigger the time domain PLC 107. The time domain PLC 107 may comprise a cross-faded mix of phase aligned extrapolation by the information stored in the temporal IMDCT buffer 103 and by the information stored in a base pitch buffer generated from information stored in the previously decoded speech buffer 102. The time domain PLC scheme which is applied in unit 107 typically depends on the loss position of the current frame. Furthermore, the system 100 comprises an embedded diffusion module 110 which also uses the information stored in the temporal de-correlated IMDCT buffer 109. The diffusion module 110 may be used to avoid "buzz" artifacts introduced by the repetition of a pitch period;

After concealment has been performed, a hybrid reconstruction may be used in hybrid reconstruction module 111 which considers the domain used and/or the loss position.

Figure 2:
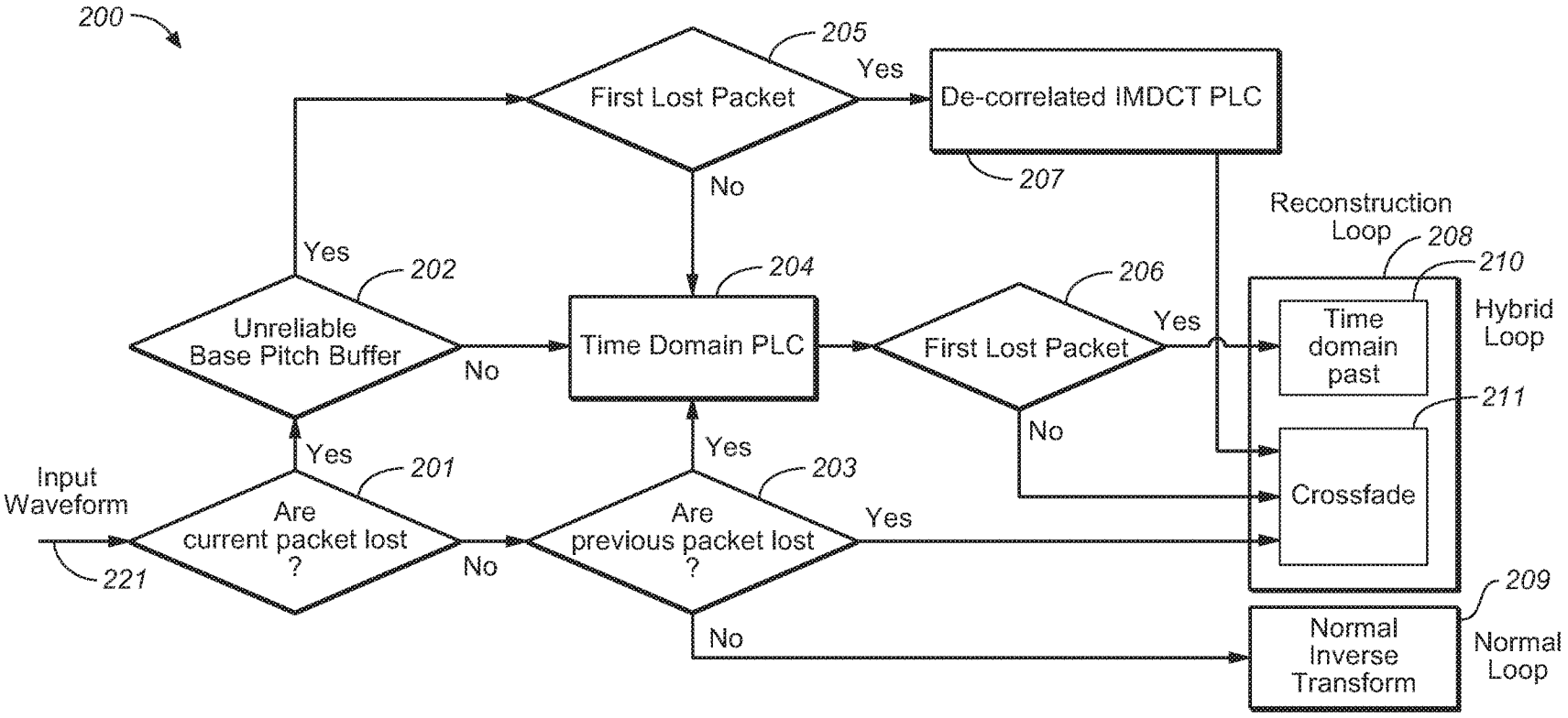
FIG. 2 shows a flow chart of an example method for packet loss concealment.

FIG. 2 shows an example decision flowchart 200 of the proposed hybrid PLC system 100. At step 201, a decision flag may be set as to whether the current MDCT frame (or packet) 313 has been lost. When a first packet loss is detected, the proposed system 100 starts to evaluate the quality of a history buffer (e.g. buffer 102) to decide whether the more stable de-correlated IMDCT PLC should be used. In other words, if a lost packet has been detected, a reliability measure for the information comprised within the base pitch buffer is determined (step 202). If the pitch information comprised within the base pitch buffer is reliable, then Time Domain PLC 204 may be applied (in unit 107), otherwise, it may be preferable to use a de-correlated IMDCT PLC scheme 207 (in unit 106). For this purpose, it may be checked, whether the lost packet is the first lost packet (step 205). If this is the case, the de-correlated IMDCT PLC scheme 207 may be used, otherwise the time domain PLC scheme 204 may be used. The time domain audio signal may be reconstructed using a reconstruction loop 208. If no packet has been lost (step 203), then normal inverse transform 209 may be applied. In case of the first (step 206) and the last lost packet a cross-fading process 211 may be applied. Otherwise, a time domain paste process 210 may be used.

In the following, a method for determining the reliability of the base pitch buffer is described. The base pitch buffer stores the previously decoded audio signals, which is needed for pitch based time domain PLC. As such, the base pitch buffer may comprise the first buffer 102. The quality of this buffer has a direct impact on the performance of pitch based PLC. Therefore the first step of the proposed hybrid system 100 is to evaluate the reliability of the base pitch buffer.

When there is a lost packet 313, the most recent received information is the last perfect reconstructed frame 306 stored in the buffer 102 (referred to as $x_{(p-1)}[n]$, $0 \le n \le N-1$) and the second half of the inverse transformed frame 322 (referred to as $\hat{x}_{(p-1)}[n]$, $N \le n \le 2N-1$, and possibly stored in buffer 103) to form the buffer $x_{base}$ for pitch estimation by concatenation. As such, the pitch buffer comprises all of the most recently received information, i.e. the fully reconstructed signal frame 306 and the second half of the aliased intermediate signal 322.

The pitch buffer $x_{base}$ may be used to perform Normalized Cross Correlation (NCC) while considering the shape of the synthesis window w[k] which is applied at the overlap-add operation 305. Within a pre-defined search range from e.g. 5 ms (lmin=80 samples) to e.g. 15 ms (lmax=240 samples), the lag will be selected that results in a maximum correlation. The range (e.g. of 5 ms to 15 ms) is selected as a typical pitch frequency range of humans' speech. Integer multiplication or division of that period can be extrapolated for modeling a pitch beyond that range. Then, the $x_{base}[n]$ may be shifted according to the lag value such that x[n] and x[n-lag] are pitch synchronized in maximization with windowed NCC, which is computed by normalizing basic correlation via tap count and window shape. Decimation and/or micro shifting techniques may be applied in order to accelerate the speed of computation of NCC, with a small degradation in accuracy. After the tapped alignment process, the windowed NCC can be used as an indicator of the confidence of the periodicity of the receiver signal, in order to form the Confidence of Voicing Measure (CVM). Assuming that the first sample index of the base pitch buffer is m, the NCC may be computed as follows:

$$NCC(lag) = \frac{\sum_{n=0}^{2N-1} x_{base}[m+n-l\max]x_{base}[m+n-l\max+lag]}{\sum_{n=0}^{2N-1} x_{base}[m+n-l\max+lag]x_{base}[m+n-l\max+lag]}; \quad 1)$$

Where m is the current time index, optimal lag is searched through range from 80 to 240 samples.

The CVM criteria for a current frame p may e.g. be computed via the following two conditions:

It may be determined whether the loss of current packet p has been an interleaved packet loss. For this purpose, it may be determined whether the packet p−2 had also been lost (whereas the packet p−1 has been received). If this is the case, then $CVM_p$ may be set to 0.0.

Furthermore, it may be determined whether the base pitch buffer lies within an unreliable area. This information may be determined based on the windowed NCC which is output by the pitch detector. The windowed NCC value for the lag value yielding the maximum correlation may be normalized to yield the confidence of reliability measure $CVM_p$, the value may be normalized to a range of 0.0 to 1.0. As such, a relatively high maximum NCC value indicates a high confidence in the periodicity of the audio signal. On the other hand, a relatively low maximum NCC value indicates a low confidence in the periodicity of the audio signal.

As such, the reliability of the base pitch buffer may be determined (step 202) using the CVM. If $CVM_p$ lies above a confidence threshold $T_c$, time domain PLC (step 204) may be used. On the other hand, if $CVM_p \le T_c$, then further processing may depend on the position of the current lost packet p. The confidence threshold $T_c$ may be in the range of 0.3 or 0.4. It is verified in step 205, whether the lost packet p is the first lost packet and if this is not the case, then time domain PLC (step 204) may be used. On the other hand, if the lost packet p is the first lost packet, then a de-correlated IMDCT PLC scheme 207 may be applied.

In the following, the de-correlated IMDCT PLC scheme 207 (also referred to as the de-correlated PLC scheme) is described in further detail. In some scenarios, if the confidence score $CVM_p$ is at or below the threshold $T_c$ (indicated as Thre in FIG. 1), which indicates a base pitch buffer which is too unstable for typical time domain PLC, frame level concealment may be performed using information from the third buffer 109 that comprises frames which are inverse-transformed by de-correlated MDCT bins.

The reason for using the de-correlated IMDCT PLC 207 for the first packet loss is the following: 1) Unlike consecutive packet losses (comprising a plurality of lost packets), a single, isolated packet loss can be concealed directly with another variant time domain buffer usually without incurring robotic artifacts due to overlap-add; 2) Frame level concealment by de-correlated IMDCT PLC can serve the purpose of energy equalization where time domain PLC fails to produce a stable base pitch buffer. For example, unvoiced portions of speech with rapid amplitude changes often cause level fluctuation in the extrapolated signal; or in cases with interleaved packet loss, the previously available base pitch buffer is actually a buffer filled with aliased signals. Furthermore, it should be noted that the de-correlated IMDCT buffer 109 can be used in a later stage for time domain diffusion in unit 110.

The de-correlated IMDCT PLC 207 is typically only used for the first packet loss. For subsequence consecutive packet losses, the time domain PLC is preferably used, as it has proven to be more powerful for bursty losses (comprising a plurality of consecutive lost packets). An additional advantage of time domain PLC is that an additional IMDCT is not needed (thereby reducing the computational cost of time domain PLC 204 with respect to a de-correlated IMDCT PLC 207).

When performing the de-correlated IMDCT PLC 207, a de-correlation process (also referred to as a diffusion process) in the MDCT domain is used to reduce possible artifacts by diffusing the MDCT coefficients. This can be realized by the algorithm described below. In order to fabricate a de-correlated MDCT packet from the previous received packet (p−1), the basic idea is to introduce more randomness and to soften the coefficients in order to smoothen the spectrum. For the last received MDCT packet (p−1) denoted as $X_{p-1}(k)$, MDCT domain de-correlation can be performed by using a low pass filter on the absolute MDCT coefficients and by randomization of the signs of the MDCT coefficients:

Low pass filtering of the absolute MDCT coefficients;

$$\overline{X}_{(p-1)}^{MDCT}=|X_{(p-1)}^{MDCT}|*h; \quad 2)$$

where h is a low-pass filter, e.g. an averaging filter, and where * is the convolution operator. As a result of low-pass filtering of the absolute MDCT coefficients of the last received packet, the diffused coefficients $\overline{X}_{(p-1)}^{MDCT}$ are smoothened with respect to the original absolute coefficients $|X_{(p-1)}^{MDCT}|$. The diffused coefficients $\overline{X}_{(p-1)}^{MDCT}$ are also referred to as a diffused set of transform coefficients.

Subsequently, a randomized sign may be applied to the diffused coefficients, e.g. within the non-tonal band:

$$\tilde{X}_{(p-1)}^{MDCT}(k)=\begin{cases}\overline{X}_{p-1}^{MDCT}(k)\cdot \mathrm{sgn}(X_{(p-1)}^{MDCT}(k)), & \text{for } k\in I_m\\ \overline{X}_{p-1}^{MDCT}(k)\cdot s(k), & \text{else}\end{cases} \quad 3)$$

where s(k) is a randomized sign (+1,−1). The tonal band, i.e. the set $I_m$ may be determined by comparing the absolute MDCT coefficients $|X_{(p-1)}^{MDCT}|$ to an energy threshold. The set $I_m$ may be given by the MDCT coefficients for which $|X_{(p-1)}^{MDCT}|>T_e$, wherein $T_e$ is the energy threshold.

The de-correlated time domain signal for the temporal de-correlated IMDCT buffer 109 may be determined as $$\check{x}_{(p-1)}[n]=\sqrt{\frac{2}{N}}\sum_{k=0}^{N-1}\tilde{X}_{(p-1)}^{MDCT}(k)\cos\left(\frac{\pi}{N}\left(n+\frac{N+1}{2}\right)\left(k+\frac{1}{2}\right)\right), \quad 4)$$

$$0\le n\le 2N-1$$

The de-correlated time domain signal $\check{x}_{(p-1)}[n]$ is also referred to as the diffused aliased intermediate frame (of the last received packet). This de-correlated time domain signal may e.g. be cross-faded with the intermediate time domain signal 322 stored within the temporal IMDCT buffer 103 to perform concealment. In particular, the first half of the samples [0, N−1] of the de-correlated time domain signal $\check{x}_{(p-1)}[n]$ stored in buffer 109 may be cross-faded with the second half of the samples [N, 2N−1] of the aliased intermediate signal $\hat{x}_{(p)}[n]$ stored in buffer 103 in the overlap-add operation 308, thereby yielding the reconstructed frame 307 $y_p[n]$ (also referred to in the present document as the estimate of the current frame of the (decoded) time domain audio signal).

After the proposed approach has been applied, it can partially be guaranteed that the previously unstable base pitch buffer can be compensated with this frame level concealment. Furthermore, in order to perform further time domain diffusion of a concealed frame (see the additional details provided in the context of the time diffusion unit 110), the above diffused buffer signal according to formula 4 may be preserved (e.g. in buffer 109). Subsequently, e.g. for subsequent lost packets p+1, p+2, etc., time domain PLC may be used.

In the following, Time domain PLC 204 (as performed in the unit 107) is described in further details. If the base pitch buffer satisfies the CVM criteria for extrapolation (step 202), time domain PLC may be used. Conventional time domain PLCs have been proposed either by using periodic waveform replication, by using linear prediction or by using CELP based coders' predictive filter memory and parameters. However, these approaches are mostly not designed for MDCT based codecs and are all based on the extrapolation of a pure time domain decoded buffer 102. They are not designed to also include the more recent received information stored in the temporal aliased IMDCT buffer 103. Furthermore, without proper handling, discontinuity can occur in time domain signals. Various techniques on removing discontinuities have been proposed, which however suffer the problems of extra delay or high computational cost.

In contrast, the proposed system 100 makes full use of the aliased intermediate signal (stored in the buffer 103) to further improve the performance of time domain PLC. Some notable properties of the proposed time domain PLC are: 1) The proposed algorithm is strictly under the framework of the MDCT based codec, and tries to perform time domain packet loss concealment based on what has been obtained from the IMDCT (notably the intermediate or aliased signal stored in buffer 103), where its unique properties can be explored; 2) The time domain PLC 204 works solely on historic signal buffer data, and no extra latency or filter analysis, e.g. LPC, are required; 3) The system 100, 107 is efficient by computing cross-faded combinations of aliased and periodically extrapolated speech signals (notably by cross-fading an aliased component generated from the second buffer 103 and a PWE component generated from the first buffer 102).

Before describing the details of time domain PLC 204, the properties of IMDCT signals are briefly illustrated. Interesting time-domain properties of MDCT based codecs are:

A partial loss observed in up and down-ramp at the beginning and end part of lost packets, respectively. This is equivalent to the filter ringing techniques while providing more future "ringing in" signal.

The real component of ramp.

Let $\hat{x}$ 323 be the reconstructed signal from IMDCT, and x be the original signal. In MDCT based codec, one typically uses symmetrical windows with $h^2[n]+h^2[N+n]=1$, for 0<=n<=N−1. The symmetrical window may be defined by formulas 5a) and 5b):

i.

$$h[n]=\sin\left(\frac{\pi}{2N}\left(n+\frac{1}{2}\right)\right),\ 0\le n\le 2N-1 \quad 5)$$

Unlike DFT, the reconstructed signal is actually not the signal itself but an aliased version of two signal parts.

$$\hat{x}_{(p)}[n]=\begin{cases}x_{(p)}[n]h[n]-x_{(p)}[N-n-1]h[N-n-1] & 0\le n\le N-1\\ x_{(p)}[n]h[n]+x_{(p)}[3N-n-1]h[3N-n-1] & N\le n\le 2N-1\end{cases} \quad 6)$$

For this reason TDAC (time-domain aliasing cancellation) may be used to yield the original signal. For a perfect reconstruction of MDCT, OLA (i.e. the overlap and add method) 308 may be used to perfectly reconstruct original signals from two aliased versions:

$$x_{(p)}[n] = \begin{cases} \hat{x}_{(p-1)}[n+N]h[N-n-1] + \hat{x}_{(p)}[n]h[n], & 0 \le n \le N-1 \\ \hat{x}_{(p)}[n]h[2N-n-1] + \hat{x}_{(p+1)}[n-N]h[n-N], & N \le n \le 2N-1 \end{cases} \quad 7)$$

This is illustrated in FIG. 3 which shows the aliased intermediate signals $\hat{x}_{(p-1)}[n]$ 322 and $\hat{x}_{(p)}[n]$ 323 and the overlap-add operation 308 of the two aliased intermediate signals 322, 323 to yield the reconstructed time domain frame 307.

The two parts which are added in the OLA 308 are irrelevant to each other. However, they have a strong relevance to the neighboring IMDCT of the time-domain signal. In other words, the aliased intermediate signals 322, 323 impact the neighboring frames due to the OLA 308 operation. By way of example, the down-ramped intermediate signal (i.e. the second half of the down-ramped aliased intermediate signal 322) can be represented as:

$$x_{(p-1)}[n]h[n]h[n]+x_{(p-1)}[3N-n-1]h[3N-n-1]h[n] \quad N \le n \le 2N-1 \quad 8)$$

As such, the aliased intermediate signal 322 $\hat{x}_{(p-1)}[n]$ comprises information on the samples $x_{(p-1)}[3N-n-1]$ which actually corresponds to samples of the frame p which is to be reconstructed.

Due to this, it is proposed in the present document to derive information for the reconstruction of the frame p (and possibly for succeeding frames p+1, p+2, etc.), not only from the perfectly time domain constructed signal $x_{(p-1)}[n]$ 306 at position $0 \le n \le N-1$ (which is stored in the first buffer 102), but also from the aliased signal $\hat{x}_{(p-1)}[n]$ 322 at position $N \le n \le 2N-1$ obtained by temporal IMDCT buffer 103, as the latter aliased signal $\hat{x}_{(p-1)}[n]$ comprises information of the frame p which is to be reconstructed.

In summary, it is proposed in the present document to keep track of one or more of the following buffers for the concealment of one or more consecutive frames p, p+1, p+2, etc.:

a first buffer 102 comprising at least the last fully decoded time domain frame 306, i.e. the samples $x_{(p-1)}[n]$, $0 \le n \le N$.

a second buffer 103 comprising at least the second half of the last received aliased intermediate signal 322, i.e. the samples $\hat{x}_{(p-1)}[n]$, $N \le n \le 2N-1$. Alternatively or in addition, the down-ramped version of the aliased intermediate signal 322 may be stored in the second buffer 103, i.e. the aliased signal 322 subsequent to the application of the (fade-out) window may be stored in the second buffer 103. This signal may be referred to as the down-ramped (or simply ramped) signal $x_{(ramp)}[n]=\hat{x}_{(p-1)}[n+N]hN-n-1$, $0 \le n \le N-1$;

a third buffer 109 comprising a de-correlated aliased signal derived from the set 312 of MDCT coefficients of the last received packet (p−1), i.e. samples $\check{x}_{(p-1)}[n]$, $0 \le n \le 2N-1$ (also referred to as the diffused intermediate frame).

As such, it is ensured that the PLC system 100 can make use of the most recent available information.

In the following, the time domain PLC 204 will be described. For control of the processing of the received or lost frames, frame types may be defined according to their loss position as is shown in FIG. 5. The lost frames are then processed in accordance to their frame type. This allows maintaining minimal robotic artifact while preserving phase continuity. In FIG. 5, a frame type "0" 501 indicates a normally received frame and a frame type "1" 502 indicates the first lost frame subsequent to one or more received frames (i.e. frames of type 501). As such, a frame type "0", 501, indicates e.g. the last normally reconstructed frame in the time domain and a frame type "1", 502, indicates a partial loss. The frames of type "1" should be determined based on the aliased down-ramped signal generated by the right part (i.e. the second half) of the intermediate IMDCT signal 322 from the last received packet and based on the up-ramped signal generated by the left part (i.e. the first half) of the IMDCT signal 323 of the next packet. This is illustrated by the line 401 in FIG. 4.

Further frame types may be the frame type "2" 503 which indicates an initial burst loss. The frame type "2" comprises e.g. the second lost frame. To conceal this frame, it may be useful for the time domain PLC 204 to derive some useful information from the concealed frame type "1", even if it is an aliased signal. A further frame type "3", 504, may indicate a successive burst loss. This may e.g. be the third lost frame up to the end of the concealment. The number of frames which are assigned to frame type "3" typically depends on the previously computed CVM, wherein the number of frames having frame type "3" typically increases with increasing CVM. The basic principle of concealing frames of type "3" is to derive information from the frame of type "1" and at the same time to preserve variability in order to prevent robotic artifact. Furthermore, frames may be assigned to frame type "4", 505, indicating a total loss of the frames, i.e. a termination of the concealment.

Figure 4:
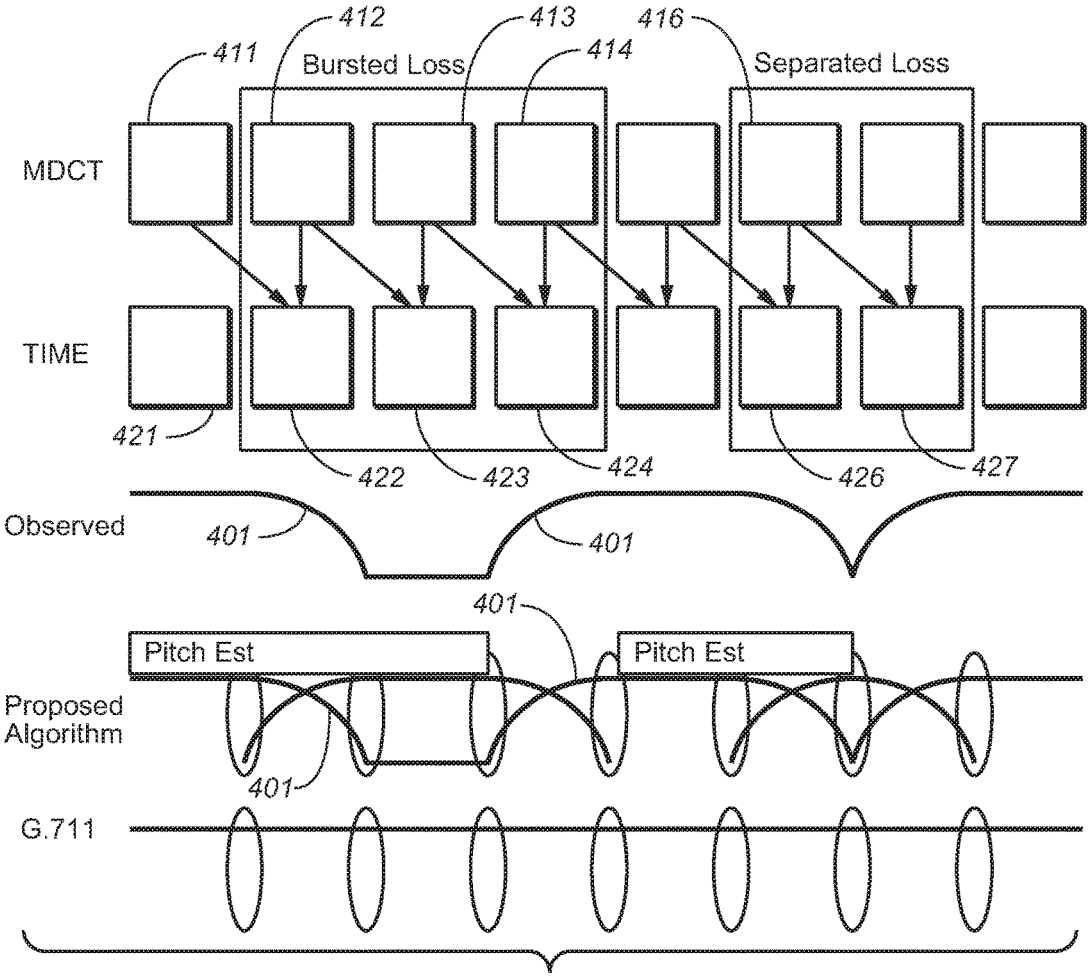
FIG. 4 illustrates the impact of one or more lost packets on corresponding frames of a time domain signal.
Figure 5:
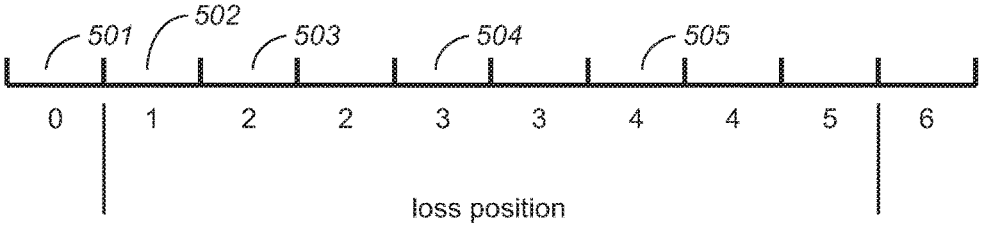
FIG. 5 illustrates different example frame types.

FIG. 4 shows a sequence of MDCT packets (or frames) 411. As already outlined in the context of FIG. 3, an MDCT packet (p−1) 411 contributes to the reconstructed time domain frames (p−1) 421 and p 422. Consequently, in case of a bursty loss of MDCT packets 412 and 413, the time domain frames 422, 423, and 424 are affected. In the illustrated example, MDCT packet 414 is again a properly received packet. Furthermore, FIG. 4 illustrated an isolated or separated loss of a single MDCT packet 416 which affects the time domain frames 426 and 427.

Several embodiments of construction principles may be considered to make the best use of the aliased signal $\hat{x}_{(p-1)}[n]$ 322 stored within the temporal IMDCT buffer 103:

Although the temporal buffer 103 contains redundantly mirrored information, the proposed algorithm doesn't change the two synthesized windows already being formed to make the transited area more smooth.

The first aliased signal 322 $\hat{x}_{(p-1)}[n]$ or the down-ramped signal $x_{(ramp)}[n]$ is stored in a state buffer 103 (line 401, 601 in frame type "1"). The down-ramp temporal IMDCT buffer is denoted as $x_{(ramp)}[n]$, which is used partially in a block-wise cross-fade mixing process.

Although the aliased IMDCT temporal buffer 103 contains causal information ahead of the base pitch buffer, the partial information is mined with the optimal phase aligned buffer in preparation for the extrapolation of the next block. In order to avoid phase discontinuity, the OLA (Overlap & Add) process is performed across heterogeneous signals.

Figure 6A:
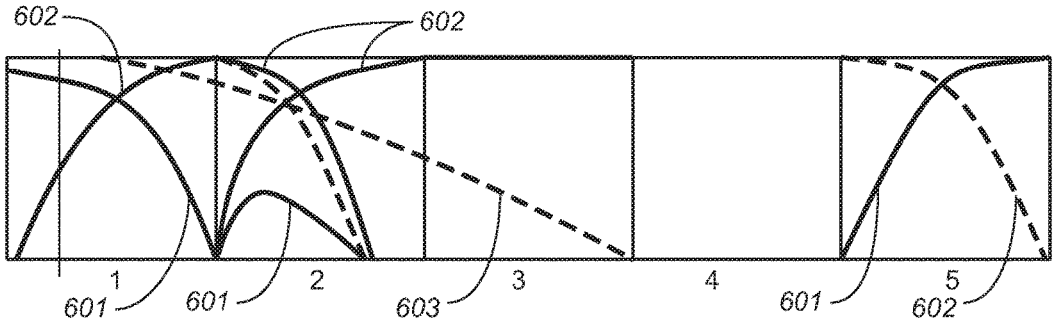

In FIG. 6*a*, line 601 represents the original down ramped and/or up ramped signal via IMDCT taken from buffer 103, line 602 represents the extrapolated version of the decoded buffer 102, and dotted line 603 represents a long-term block-wise attenuation factor. As such, FIG. 6*a* illustrates how the information from buffers 102, 103 and possibly 109 (see FIG. 6*d*) may be used for the concealment process. Details of the concealment process performed in the context of Time Domain PLC 204 will be described in the following with reference to FIGS. 6*b* to 6*d* and 7.

Processing of Frames of Type "0":

Typically, no concealment is performed for frames of type "0". However, the type "0" frames are used to determine various parameters and to fill the buffers 102, 103 and 109. In particular, the pitch (in particular the pitch period W may be determined based on the NCC scheme outlined above. Furthermore, the confidence measure CVM may be determined as outlined above. The CVM may be used to decide on the extrapolated concealment length, i.e. on the number of consecutive lost frames for which concealment is performed. For CVM above a high threshold, which indicates vowels, or CVM below a low threshold and a high low band energy ratio above a threshold (fricative), concealment of up to 4 frames may be appropriate; for plosives (having a relatively low CVM value), concealment of up to 2 frames may be appropriate; and for nasal, semivowel and everything else, concealment length of up to 3 frames may be appropriate. As such, the number of consecutive lost packets for which concealment is performed may depend on the value of the confidence measure CVM. Typically, the number of concealed packets increases with an increasing value of CVM. In a similar manner, the attenuation factor 603 may depend on the confidence measure CVM, wherein the gradient of the attenuation factor 603 is typically reduced with an increasing value of CVM.

Processing of Frames of Type "1":

Usually, traditional time domain PLC like G.711 takes advantages of the last base pitch buffer for periodical waveform extrapolation. However, making a smooth transition with aligned phase is an important issue. Thanks to the ramped signal, in the present case, it is not needed to perform a ringing out or span pitch period cross-fade process to ensure a smooth transition from received and lost frames. Instead, for the first buffer 102 comprising the completely decoded signal (line 611 in FIG. 6*b* or reference numeral 306 in FIG. 3), a conventional periodical waveform extrapolation (PWE) may be performed by increasing the pitch period of the frame $x_{(p-1)}[n]$, $0 \le n \le N-1$ 306 stored in the previously decoded buffer 102. This may be done for each replication round (i.e. for each frame p, p+1, p+2, etc. which is to be concealed) in order to prepare the concealed buffer. In order to avoid phase discontinuity, the pitch period buffer can be acquired by cross-fading boundary regions of successive pitch:

$$x_{PWE}[n] = \begin{cases} x_{(p-1)}[N-W+n], & 0 \le n \le 3W/4-1 \\ CF(x_{(p-1)}[N-W+n], x_{(p-1)}[N-2W+n]), & 3W/4 \le n \le W-1 \end{cases} \quad 9)$$

Where $x_{(p-1)}[n]$, $0 \le n < N$ denotes the samples stored in the previous decoded buffer 102, and where W is the pitch period. After the concealed buffer is ready, time domain cross-fade may be used to generate synthesized signal.

In other words, periodical waveform extrapolation (PWE) may be applied on the data $x_{(p-1)}[n]$, $0 \le n < N$ stored in the first buffer 102. For this purpose, the pitch period W is determined, e.g. based on the NCC analysis described above. In particular, the pitch period W may correspond to the lag value (different from zero) providing a maximum of the normalized cross-correlation function NCC(lag). Using the pitch period W, a pitch period buffer $x_{PWE}[n]$ comprising W samples may be determined (e.g. using formula 9)). The pitch period buffer $x_{PWE}[n]$ may be appended several times (circular copying process) to yield the concealed buffer. This is illustrated by signal 621 which comprises a plurality of appended pitch period buffers $x_{PWE}[n]$ 622. Furthermore, it should be noted that the signal 621 may comprise a fraction 623 of a pitch period buffer $x_{PWE}[n]$ 622 at the end, due to the fact that N may not be an integer multiple of W. The signal 621 may be referred to as a concealed signal or the PWE component $\bar{x}_{PWE}[n]$ 621, with $$\bar{x}_{PWE}[n] = x_{PWE}[n \bmod W],\ n=0,1 \ldots ,N-1.$$

Furthermore, it may be ensured that the concealed signal (also referred to as the PWE component) 621 is phase aligned with the preceding signal 306 since there will be a fade-in window applied in the concealed signal. Alternatively or in addition, a fade-in window may be applied to the PWE component 621, thereby allowing the PWE component 621 to be concatenated directly to the preceding signal 306, even in cases where there is no phase alignment. As the above formula shows, the PWE component $\bar{x}_{PWE}[n]$ 621 is obtained by appropriate concatenation of a plurality of pitch period buffers $x_{PWE}[n]$ 622.

In order to reconstruct a frame of frame type "1", the ramp-down signal $x_{(ramp)}[n]$, $N \le n \le 2N-1$ (612 in FIG. 6*b*) stored in the second buffer 103 may be taken into account. This aliased signal is automatically phase aligned with the previous frame 306, therefore no explicit phase alignment is required. The aliased signal $\hat{x}_{(p-1)}[n]$ (also referred to as the aliased component) may be overlaid (or cross-faded) with the concealed signal 621 to yield an estimate of a non-windowed version of the aliased signal 323, i.e. $\bar{x}_{(p)}[n]$, $0 \le n \le N-1$. For this purpose, the concealed signal 621 may be submitted to a fade-in window 624 and the windowed concealed signal 621 may be added to the ramp-down signal $x_{(ramp)}[n]$ 612 (no extra fade-out window needs to be applied, due to the fact that the ramp-down signal $x_{(ramp)}[n]$ 612 has already been submitted to a window in the context of the IMDCT transform). In other words, it may be stated that the PWE component 621 and the aliased component (which has not yet been submitted to a window function) are cross-faded.

It should be noted that the windowed concealed signal 621 or the resulting overlaid signal may be submitted a long-term attenuation $f_{atten}[n]$ illustrated by the dotted line 603. The long-term attenuation $f_{atten}[n]$ leads to a progressive fade-out of the reconstructed signal over a plurality of lost frames. As indicated above, the long-term attenuation $f_{atten}[n]$ may depend on the value of CVM.

The resulting overlaid signal may be used in the context of an overlap-add operation 308 to yield the reconstructed or synthesized frame $y_{(p)}[n]$. In other words, the resulting overlaid signal may be used to determine the estimate of frame p of the decoded time domain audio signal.

Processing of Frames of Type "2":

Conventional time domain PLC schemes do not make use of the information of the ramped-down signal (i.e. of the aliased signal 322) created by the IMDCT. In the context of the processing of fame type "1", it has been described how to incorporate the ramped-down signal (also referred to as the down-ramped signal) stored in the buffer 103 to generate a reconstructed frame $y_{(p)}[n]$. The frame type "2" is already preceded by a lost frame, and one possible way of reconstructing a frame of frame type "2" could be to use the reconstructed frame $y_{(p)}[n]$ as the next round base pitch buffer in PWE. However, this process has several drawbacks: 1) Introduce discontinuity, because the beginning phase of the next frame is only aligned with the extrapolated pitch period in frame type "1" (reference numeral 621 in FIG. 6*b*), but not aligned with the temporal IMDCT buffer (reference numeral 612 in FIG. 6*b*); 2) Synthesized signal based PWE may make use of the right part of frame type "1". It should be noted, however, that the right part of the down ramped alias signal (reference numeral 612) in frame type "1" contains mainly alias compared with the left part of the alias signal (actually the right part of the alias signal 612 contains redundant information of the left part with the mirrored signal taking dominance as outlined above).

In the present document, it is proposed to conceal a type "2" frame based on the concealed buffer comprising copies of the pitch period buffers $x_{PWE}[n]$ 622, thereby yielding a concealed signal $\bar{x}_{PWE}[n]$ 631 from continuous extrapolation of the information stored in buffer 102. The concealed signal 631 (also referred to as the PWE component) comprises a fraction 632 of a pitch period buffer $x_{PWE}[n]$ 622 at the beginning of the signal 631, wherein the fraction 632 at the beginning of the concealed signal 631 and the fraction 623 at the end of the preceding concealed signal 621 form a complete pitch period buffer $x_{PWE}[n]$ 622.

In order to align the phase of the aliased signal 612 stored in buffer 103 with the phase of the concealed signal 631, it is proposed to shift the aliased signal 612, such that its phase is aligned with the phase of the signal 631, thereby maximizing the degree of continuity between a frame type "1" and a succeeding frame type "2". As indicated above, the down-ramped signal $x_{(ramp)}[n]$ may be stored in the temporal IMDCT buffer, with:

$$x_{(ramp)}[n]=\hat{x}_{(p-1)}[n+N]h[N-n+1],\ 0\leq n\leq N-1 \tag{10}$$

The phase shift position in the circular base pitch buffer at the end of a first (type "1") frame concealment can be represented by:

$$i.\ pwe_s=N \bmod W. \tag{11}$$

Concealment like frame type "1" using PWE yields the concealed signal (or PWE component) 631:

$$\bar{x}_{PWE}[n]=x_{PWE}[(pwe_s+n)\bmod W],\ n=0,1\ldots,N-1 \tag{12}$$

In order to align the concealed signal $\bar{x}_{PWE}[n]$ 631 for the second lost frame and the down-ramp signal $x_{(ramp)}[n]$ stored in the temporal IMDCT buffer 103, the down-ramp signal $x_{(ramp)}[n]$ should be shifted (towards the left) by an amount of samples corresponding to $pwe_s$, thereby ensuring phase continuity between the first reconstructed frame $y_{(p)}[n]$ and the succeeding reconstructed frame $y_{(p+1)}[n]$. In other words, the position $pwe_s$ in ramp signal $x_{(ramp)}[n]$ is the best matching place in terms of phase for starting to extrapolate the second frame. An optimal phase aligned partial ramp chunk can be obtained as $x_{(ramp)}[n]$, $n=pwe_s, pwe_s+1, \ldots N-1$ (This chunk of the down-ramp signal $x_{(ramp)}[n]$ is illustrated by the curve 604 in FIG. 6*a* and curve 633 in FIG. 6*c*) by tracing back to the corresponding phase position of the down-ramped signal $x_{(ramp)}[n]$ in the buffer 103. The above mentioned phase alignment may be obtained by omitting $pwe_s$ samples at the beginning of the ramp signal $x_{(ramp)}[n]$.

As a result of the phase-alignment of the concealed signal 631 and the down-ramp signal 633, the two signals may be merged via crossfade using a fade-out window $wo_{N-pwe_s}[n]$ 634 for the concealed signal $\bar{x}_{PWE}[n]$ 631 and a fade-in window $wi_{N-pwe_s}[n]$ 635 for the phase-aligned down-ramped signal $x_{(ramp)}[n]$ 633. In doing so, the aliased signal 633 becomes less sharp at its two edges and has a convex in the middle (represented by the line 636 in FIG. 6*c*).

After this process, the right part of the cross-faded signal may be filled with another phase aligned fade-in window using the concealed signal $\bar{x}[n]$, so the total reconstructed signal becomes $$y_{(p+1)}[n]=\begin{cases}(wo_{N-pwe_s}[n]\bar{x}_{PWE}[n]+wi_{N-pwe_s}[n]x_{(ramp)}[n+pwe_s]+wi_N[n]\bar{x}_{PWE}[n]), \\ \quad n=0,1,\ldots,N-pwe_s-1; \\ wi_N[n]\bar{x}_{PWE}[n],\ n=N-pwe_s,N-pwe_s+1,\ldots N-1\end{cases} \tag{13}$$

Where $wi_n$ is a n-sample fade-in window and $wo_N$ is a n-sample fade-out window. An example for $wi_N[n]$ is illustrated by curve 637 of FIG. 6*c*.

Figure 6D:
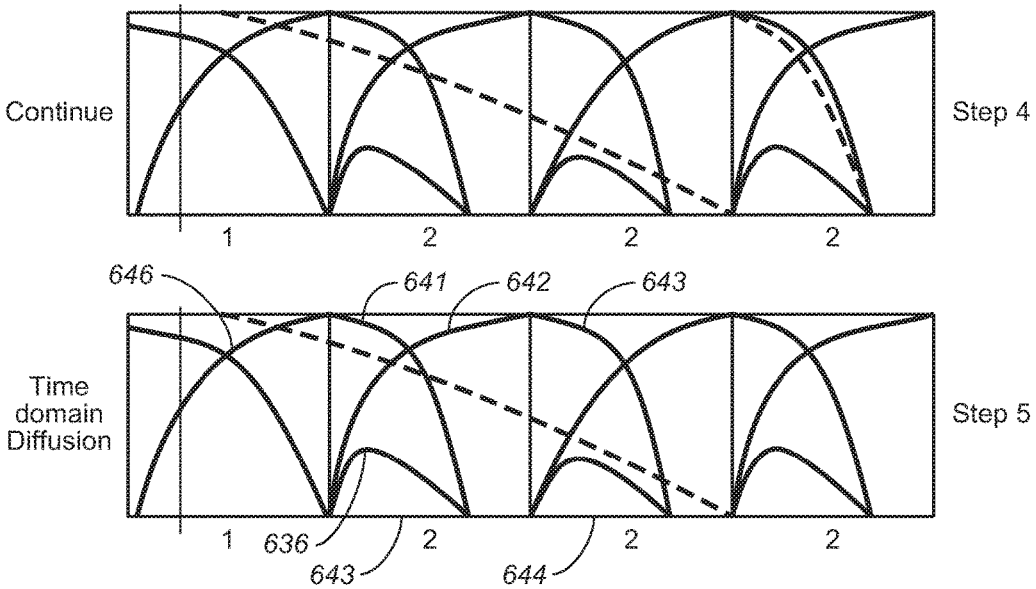
Figure 6B:
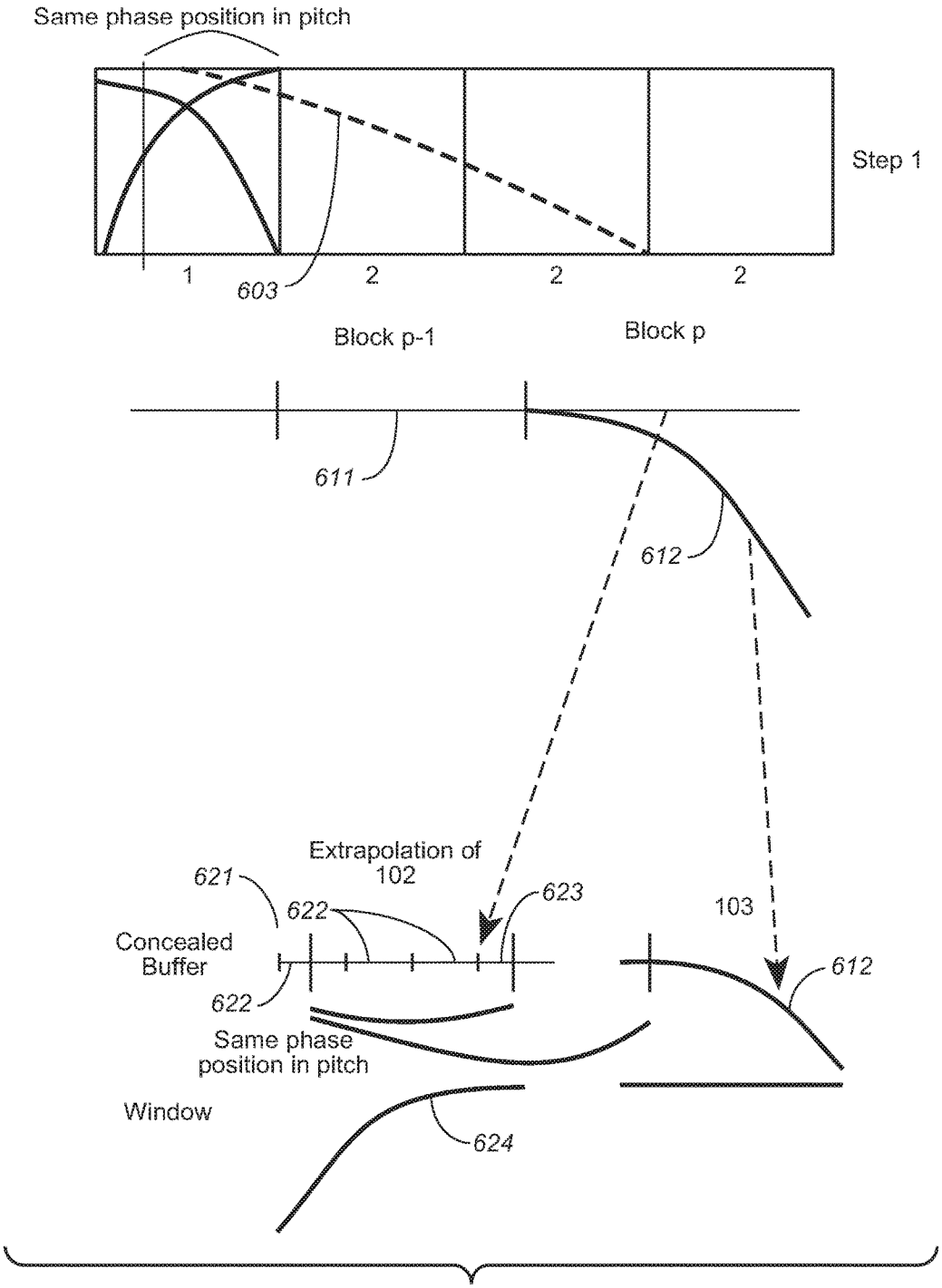
Figure 6C:
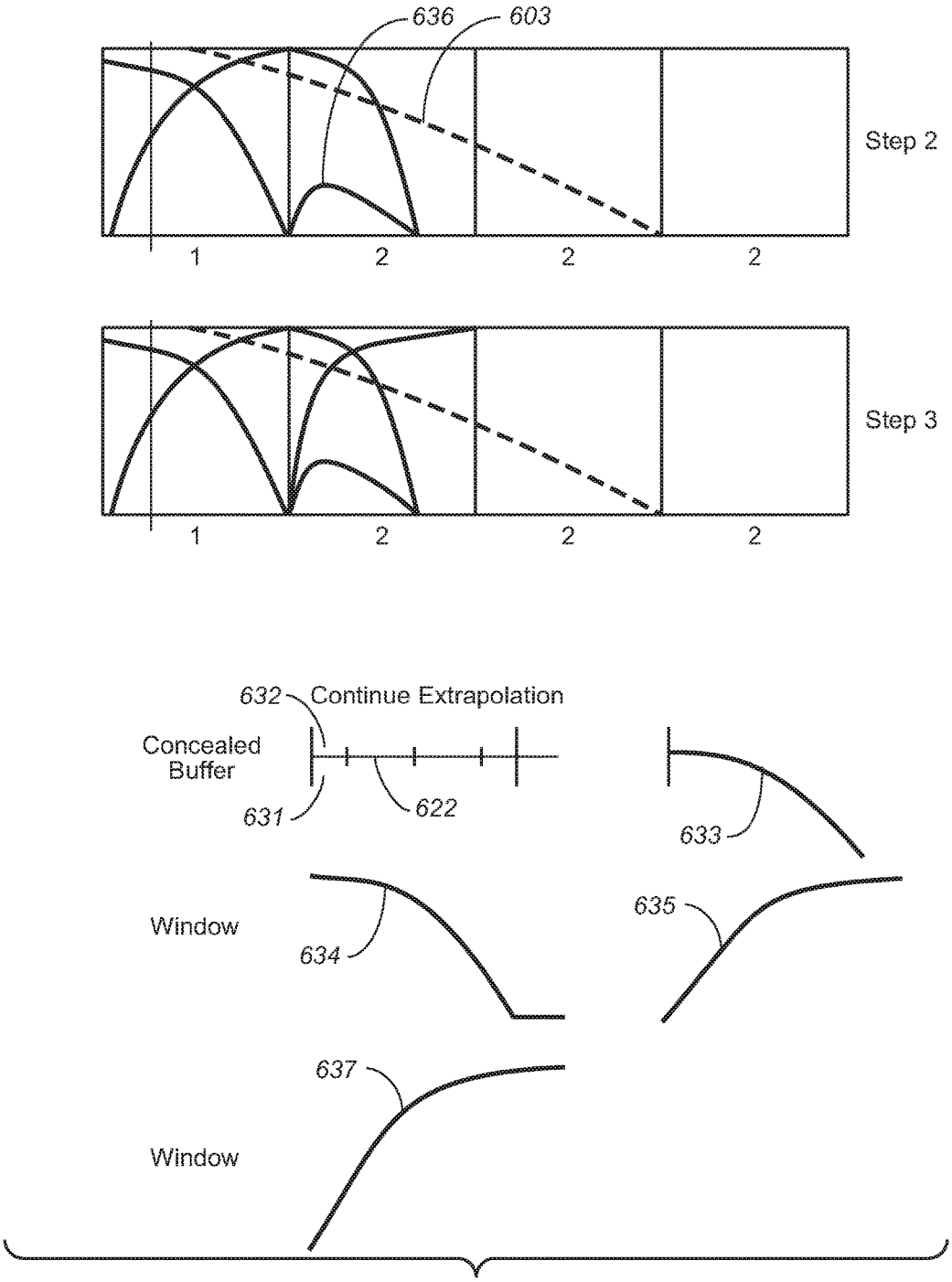

It should be noted that the overall long-term attenuation $f_{atten}[n]$ may be applied to the reconstructed signal (as illustrated by curve 603 in FIG. 6*c*). Furthermore, it should be noted that the above mentioned process may be repeated for further type "2" frames.

The above mentioned process has been described under the assumption that the second buffer 103 comprises the down-ramped signal $x_{(ramp)}[n]$. It should be noted that in an equivalent manner, the above mentioned process may be described when using the (non-windowed) aliased intermediate signal $\hat{x}_{(p-1)}[n]$.

Processing of Frames of Type "3":

For frame type "3", the same process as for frame type "2" can be performed. However, if low complexity is desired, it may be preferable to perform PWE according to G.711 and to then apply the long-term attenuation factor $f_{atten}[n]$.

Processing of Frames of Type "4":

In the proposed system 100, silence is injected for a packet loss longer than a pre-computed maximum conceal length which may be determined from a frame type classifier (e.g. based on the value of the confidence measure CVM).

As can be seen from "Step 4" in FIG. 6*d*, the repeated reconstruction of succeeding lost frames (type "2") may lead to a repeating frame pattern which may lead to undesirable artifacts, such as a "robotic" sound. For this purpose, a time diffusion process is proposed in the following. In other words, even with position dependent processing and the availability of the temporal aliased IMDCT buffer 103, periodically extrapolated waveforms may still cause some "buzz" sounds, especially for quasi-periodic speech or speech in noisy condition. This is because the extrapolated waveform is more periodic than the original corresponding lost frames. In the present document is it proposed to further reduce the "buzz" artifact by keeping two base pitch buffers in the time domain: the original base pitch buffer (determined based on the last received packet (p−1)) and a diffused base pitch buffer (determined through further processing of the last received packet (p−1)), respectively.

Signal diffusion may be achieved via de-correlation of the MDCT coefficients, as has already been described in the context of the above MDCT domain PLC 207, where low pass filtering and randomization is performed on the received set 312 of MDCT coefficients. For time domain PLC 204, however, an additional pair of MDCT/IMDCT transforms may be needed in order to diffuse the MDCT coefficients. However, going back to the MDCT domain can be computationally expensive. Therefore, in the proposed system 100 a second base pitch buffer is maintained, where its content is obtained via inverse transforming of the already diffused MDCT coefficients (see formula 3).

After de-correlating MDCT coefficients (see formula 3), two sets of MDCT coefficients are available, the original MDCTS coefficients $X_{(p-1)}^{MDCT}$ and the de-correlated MDCT coefficients $\tilde{X}_{(p-1)}^{MDCT}$. The inverse MDCT is applied to these two versions of last received MDCT coefficients, thereby yielding the aliased intermediate signal $\hat{x}_{(p-1)}[n]$ 322 and the de-correlated signal $\check{x}_{(p-1)}[n]$ (also referred to as the diffused intermediate frame), respectively:

$$\hat{x}_{(p-1)}[n]=\sqrt{\frac{2}{N}}\sum_{k=0}^{N-1}X_{(p-1)}^{MDCT}(k)\cos\left(\frac{\pi}{N}\left(n+\frac{N+1}{2}\right)\left(k+\frac{1}{2}\right)\right),\quad 0\leq n\leq 2N-1 \tag{14}$$

$$\check{x}_{(p-1)}[n]=\sqrt{\frac{2}{N}}\sum_{k=0}^{N-1}\tilde{X}_{(p-1)}^{MDCT}(k)\cos\left(\frac{\pi}{2}\left(n+\frac{N+1}{2}\right)\left(k+\frac{1}{2}\right)\right),\quad 0\leq n\leq 2N-1 \tag{15}$$

In the above formula, the aliased signal $\hat{x}_{(p-1)}(n)$ may be obtained via a normal decoding procedure, whereas the de-correlated signal $\check{x}_{(p-1)}(n)$ may be the result of the above described de-correlated IMDCT PLC.

The two base pitch buffers may be generated by cross-fading the aliased signal $\hat{x}_{(p-1)}(n)$ with the second portion of the $(p-2)^{th}$ IMDCT frame, respectively (using the overlap-add operation 305) (i.e. with the second part of the aliased intermediate frame derived from the $(p-2)^{th}$ packet):

$$x_{(p-1)}[n]=\hat{x}_{(p-2)}[n+N]h[N-n-1]+\hat{x}_{(p-1)}[n]h[n],\quad 0\le n\le N-1 \tag{16}$$

$$\tilde{x}_{(p-1)}[n]=\hat{x}_{(p-2)}[n+N]h[N-n-1]+\tilde{x}_{(p-1)}[n]h[n],\quad 0\le n\le N-1. \tag{17}$$

As a result of the above mentioned overlap-add operation 305, the reconstructed time domain frame $x_{(p-1)}[n]$ is obtained (which may be used to determine the original base pitch buffer for periodical waveform extrapolation (PWE)) and a de-correlated time domain frame $\tilde{x}_{(p-1)}[n]$ is obtained (which may be used to determine a diffused base pitch buffer for a diffused periodical waveform extrapolation (PWE)). Thus, the original and the diffused base pitch buffers can be acquired after the pitch period W has been determined via a pitch tracker (e.g. using the above mentioned NCC process). The original pitch period buffer $x_{(p-1)PWE}[n]$ and the diffused pitch period buffer $\tilde{x}_{(p-1)PWE}[n]$ may be determined as follows:

$$x_{(p-1)PWE}[n] = \begin{cases} x_{(p-1)}[N-W+n], & 0 \le n \le 3W/4-1 \\ CF(x_{(p-1)}[N-W+n],\ x_{(p-1)}[N-2W+n]), & 3W/4 \le n \le W-1 \end{cases} \tag{18}$$

$$\tilde{x}_{(p-1)PWE}[n] = \begin{cases} \tilde{x}_{(p-1)}[N-W+n], & 0 \le n \le 3W/4-1 \\ CF(\tilde{x}_{(p-1)}[N-W+n],\ \tilde{x}_{(p-1)}[N-2W+n]), & 3W/4 \le n \le W-1 \end{cases} \tag{19}$$

Where CF denotes a cross-fade process. It should be noted that typically for $N\le n\le 2N-1$, diffusion is not applied. Instead, the original IMDCT temporal buffer 103 is preserved as indicated by the curve 636 in FIG. 6*d*. In other words, in the present document, it is proposed to not apply diffusion to the aliased signal stored in buffer 103.

Due to the aliasing properties of the inverse MDCT, if the above mentioned original pitch period buffer $x_{(p)PWE}[n]$ and the diffused pitch period buffer $\tilde{x}_{(p)PWE}[n]$ are alternated during replication, there may be problems caused by waveform discontinuity, which can be seen from the misaligned phase at the joint parts of the two base pitch buffers. However, in the proposed system 100, it can be seen that the two base pitch buffers circularly extrapolate signals in a finite length, which are depicted by the lines 641 and 642 in FIG. 6*d*, the two parallel lines are referred to as pPWEPrev and pPWENext, respectively. With diffusion applied, due to the block-wise extrapolation, it can be observed that the overlap-add operation gradually transits between one piece of waveform and the next overlapping piece of transform. Consequently, waveform discontinuity will be smoothed out at the frame boundaries. Thus, two different base pitch buffers can be used in the extrapolation alternately without causing discontinuity. As is shown in FIG. 6*d*, at the boundary of two blocks 643 and 644, a second base pitch buffer 645 is derived from the same type of base pitch buffer 642 and is phase aligned. By way of example, in FIG. 6*d*, at the boundary of the first and second frame, the original base pitch buffer indicated by line 646 is extrapolated with a seamless connection (line 641), where at the boundary of the second and third frame, the de-correlated base pitch buffer indicated by the line 642 is extrapolated with seamless connection (indicated by line 645).

As such, it is proposed to alternate the two base pitch buffers from frame to frame. As is shown in FIG. 6*d*, the original pitch period buffer $x_{(p-1)PWE}[n]$ is used for concealment of the $1^{st}$ and $2^{nd}$ lost frame. Since the $2^{nd}$ lost frame, $x_{(p-1)PWE}[n]$ is denoted as pPWEPrev and $\tilde{x}_{(p-1)PWE}[n]$ is denoted as pPWENext. For the $3^{rd}$ lost frame, change is applied alternatively by using $\tilde{x}_{(p-1)PWE}[n]$ as pPWEPrev and $x_{(p-1)PWE}[n]$ as pPWENext. All the other procedures are the same as outlined previously.

In other words, formula (13) may be modified by swapping the use of $\tilde{x}_{(p-1)PWE}[n]$ and $x_{(p-1)PWE}[n]$ in an alternating manner. For the $2^{nd}$ lost frame, $x_{(p-1)PWE}[n]$ is used with the fade-out window $wo_{N\text{-}pwe_s}[n]$ and $\tilde{x}_{(p-1)PWE}[n]$ is used in conjunction with the fade-in window $wi_N[n]$. For the following lost frame, the assignment is inversed, and so on. As a result, it can be ensured that the pitch period buffer which is used with the fade-in window in a first frame is used with a fade-out window in the succeeding second frame, and vice versa.

In yet other words, it is proposed to determine a diffused component using PWE of a diffused pitch period buffer $\tilde{x}_{(p-1)PWE}[n]$. The diffused component may be used in an alternating manner with the PWE component (generated from the original pitch period buffer $x_{(p-1)PWE}[n]$, thereby reducing undesirable "buzz" or "robotic" artifacts.

As indicated in FIG. 2, if a current packet has been received, it is checked (step 203) whether the previous frame has been received. If yes, normal IMDCT and TDAC are performed when reconstructing the time domain signal (step 209). If not, PLC needs to be performed because the received packet only generates half of the signal after IMDCT (frame type "5"), with the other half aliased signal awaiting to be filled. This frame is called frame type "5" as is shown in FIG. 5. This is another advantage of the PLC system 100 since the partial loss appears in form of an up-ramp, which can provide a natural fade-in signal in connection with future received frames.

Processing of Frames of Type "5":

Since it cannot be anticipated when the next packet arrives, frame type "5" may happen to be identical with frame type 1, 2, 3, 4, depending on the loss position. The concealment procedure is also the same according to its corresponding frame type. One can modify the next packet with a forward MDCT using the previous and current concealed frame to get a more smooth transition between lost and received frame:

$$\hat{X}_p(k)=\mathrm{MDCT}(\hat{x}_{(p-1)}[n];\hat{x}_{(p)}[n]) \tag{20}$$

$$\overline{X}_p(k)=MIX(X_p(k),\hat{X}_p(k)) \tag{21}$$

In the above formula, $\hat{X}_p(k)$ represents the resulting MDCT coefficients generated by forward MDCT, $X_p(k)$ represents the next received packet, where $\overline{X}_p(k)$ is the modified next packet.

The above methods allow to generate an estimate of one or more lost frames. The question remains, how these estimates are concatenated to yield the reconstructed audio signal. In the present document a hybrid reconstruction is proposed which is illustrated in FIG. 2 (steps 208, 210, 211) and FIG. 7. In a normal reconstruction process without packet loss, the windowed overlap-add operation is performed on the IMDCT signals of two half in succession in order to achieve Time Domain Alias Cancellation (TDAC) (step 209).

However, when there is a packet loss, the TDAC property is lost if directly adding the PLC extrapolated signals with the ramped IMDCT signal. This may create an undesirable impact. In the present document, it is proposed to combine the analysis and synthesis window together in the reconstruction process thereby reducing the artifact brought by aliasing (this is referred to herein as TDAR (Time domain Aliasing Reduction)). After pitch estimation, we can have an estimated version of the original signal in down ramp area using pitch period back trace at integer times using previously perfect signals. For the first lost packet p, let $x_{(p)}[n]$ be the ground truth signal, $\bar{x}_{(p)}[n]$ be the concealed signal after processing frame type "1", $\hat{x}_{(p-1)}[n]$ be the intrinsic aliased signal by IMDCT of packet p−1. Thus we can perform time domain up-ramp twice using cosine windows in order to rebuild less aliased signal by shifting alias from side to middle:

$$\begin{aligned} y_{(p)}[n] &= \hat{x}_{(p-1)}[N+n]h[n] + \bar{x}_{(p)}[n]h[3N-n-1]h[3N-n-1] \\ &= x_{(p)}[n]h[n]h[n] + x_{(p)}[3N-n-1]h[3N-n-1]h[n] + \\ &\quad \bar{x}_{(p)}[n]h[3N-n-1]h[3N-n-1] \\ &\cong x_{(p)}[n](h[n]h[n] + h[3N-n-1]h[3N-n-1]) + \\ &\quad x_{(p)}[3N-n-1]h[3N-n-1]h[n] \end{aligned}$$

Because: $w^2[n] + w^2[N-n+1] = 1$, and $$\text{i. } w[n] = \begin{cases} h[n]; & 0 \le n \le N-1 \\ h[2N-n+1]; & N \le n \le 2N-1 \end{cases}$$

$$\text{So: } y_{(p)}[n] \cong x_{(p)}[n] + x_{(p)}[3N-n-1]h[3N-n-1]h[n] \cong x_{(p)}[n] + 0.5 * x_{(p)}[3N-n-1]h[2n]$$

Just like switching from sin α to sin 2α, the risk of aliasing can be transferred from side to middle (as is shown by curves 801 and 802 in FIG. 8), which provides a solid basis for extrapolating the next portion of speech.

Such a two-fold windowing process is applied to the other types of frames as long as it belongs to a transitional frame during reconstruction. Note that if frame type "4" appears, this cross-fade will not be performed since the concealed buffer is zero. For all other frame types, if the time domain concealment doesn't occur at the transitional part between a last lost and a first received frame (or a last received frame and a first lost frame), hybrid reconstruction it typically replaced by direct time domain paste, instead. In other words, the above mentioned cross-fade process is preferably used for frame types "1" and "5".

FIG. 7 provides an overview of the functions of the PLC system 100. Based on the one or more last received sets 312 of MDCT coefficients (i.e. based on the one or more last received packets 411), the system 100 is configured to perform a pitch estimation 701 (e.g. using the above mentioned NCC scheme). Using the estimated pitch period W, a pitch period buffer 702 $x_{(p-1)PWE}[n]$ may be determined. The pitch period buffer 702 may be used to conceal the frame types "1", "2", "3", "4" and/or "5". Furthermore, the system 100 may be configured to determine the alias signal or the down-ramped signal 703 from the one or more last received packets 411. In addition, the system 100 may be configured to determine a de-correlated signal 704.

When a packet 412 is lost, a lost decision detector 104 may determine the number of consecutively preceding lost packets 412. The concealment processing performed in unit 705 depends on the determined loss position. In particular the loss position determines the frame type, with different PLC processing being applied to different frame types. By way of example, cross-fading 706 using twice the window function is typically only applied for the frame type "1" and frame type "5". As a result of the position dependent PLC processing a concealed time domain signal 707 is obtained.

In the present document, a method and system for concealing packet loss has been described. In particular, it is proposed to make the concealment scheme which is applied dependent on the loss position of the frame which is to be concealed. Alternatively or in addition, it is proposed to make use of the aliased signal of the last received packet when performing concealment, thereby improving the quality of the concealed frames. Alternatively or in addition, it is proposed to apply a diffusion scheme, thereby reducing the extent of "buzz" or "robotic" artifacts in the reconstructed signal.

The methods and systems described in the present document may be implemented as software, firmware and/or hardware. Certain components may e.g. be implemented as software running on a digital signal processor or microprocessor. Other components may e.g. be implemented as hardware and or as application specific integrated circuits. The signals encountered in the described methods and systems may be stored on media such as random access memory or optical storage media. They may be transferred via networks, such as radio networks, satellite networks, wireless networks or wireline networks, e.g. the Internet. Typical devices making use of the methods and systems described in the present document are portable electronic devices or other consumer equipment which are used to store and/or render audio signals.

The invention claimed is:

1. A method comprising receiving, by an audio processor, a packet including a set of modified discrete cosine transform (MDCT) coefficients associated with a frame that includes time-domain samples of an audio signal;

determining, by the audio processor, that the received packet includes one or more errors;

generating, by the audio processor, estimated MDCT coefficients to replace the received set of MDCT coefficients, the estimated MDCT coefficients being based on corresponding MDCT coefficients associated with a last received packet that directly precedes the received packet in a sequence of packets;

assigning, by the audio processor, signs to a first subset of the estimated MDCT coefficients to be equal to corresponding signs of the corresponding MDCT coefficients of the last received packet, the first subset of estimated MDCT coefficients being associated with tonal bands of the last received packet;

randomly assigning, by the audio processor, signs to a second subset of the estimated MDCT coefficients, wherein the second subset of estimated MDCT coefficients are associated with non-tonal bands of the last received packet;

generating, by the audio processor, a concealment packet based on the set of estimated MDCT coefficients; and replacing, by the audio processor, the received packet with the concealment packet.

2. The method of claim 1, further comprising:

determining, by the audio processor, whether the MDCT coefficients are associated with the tonal bands or the non-tonal bands by comparing the MDCT coefficients with an energy threshold associated with the last received packet.

3. The method of claim 1, wherein the estimated MDCT coefficients are set equal to the corresponding MDCT coefficients of the last received packet.

4. The method of claim 1, further comprising:

generating, by the audio processor, an intermediate frame including windowed time-domain aliased samples from the concealment frame by means of an inverse MDCT (IMDCT); and modifying, by the audio processor, the windowed time-domain aliased samples of the intermediate frame based on the windowed time-domain samples of the audio signal.

5. The method of claim 1, further comprising:

generating, by the audio processor, an estimated decoded frame by adding a first half of the generated intermediate frame to a second half of a previously generated intermediate frame comprising windowed time-domain aliased samples associated with the last received packet.

6. A packet loss concealment (PLC) system comprising:

a detector configured to:

receive a packet including a set of modified discrete cosine transform (MDCT) coefficients associated with a frame that includes time-domain samples of an audio signal; and detect that the received packet includes one or more errors; and a PLC unit configured to:

generate estimated MDCT coefficients to replace the received set of MDCT coefficients, the estimated MDCT coefficients being based on corresponding MDCT coefficients associated with a last received packet that directly precedes the received packet in a sequence of packets;

assign signs to a first subset of the estimated MDCT coefficients to be equal to corresponding signs of the corresponding MDCT coefficients of the last received packet, the first subset of estimated MDCT coefficients being associated with tonal bands of the last received packet;

randomly assign signs to a second subset of the estimated MDCT coefficients, wherein the second subset of estimated MDCT coefficients are associated with non-tonal bands of the last received packet;

generate a concealment packet based on the set of estimated MDCT coefficients; and replace the received packet with the concealment packet.

7. The PLC system of claim 6, wherein the PLC unit is further configured to:

determine whether the MDCT coefficients are associated with the tonal bands or the non-tonal bands by comparing the MDCT coefficients with an energy threshold associated with the last received packet.

8. The PLC system of claim 6, wherein the estimated MDCT coefficients are set equal to the corresponding MDCT coefficients of the last received packet.

9. The PLC system of claim 6, wherein the PLC unit is further configured to:

generate an intermediate frame including windowed time-domain aliased samples from the concealment frame by means of an inverse MDCT (IMDCT); and modify the windowed time-domain aliased samples of the intermediate frame based on the windowed time-domain samples of the audio signal.

10. The PLC system of claim 6, wherein the PLC unit is further configured to:

generate an estimated decoded frame by adding a first half of the generated intermediate frame to a second half of a previously generated intermediate frame comprising windowed time-domain aliased samples associated with the last received packet.

11. The PLC system of claim 6, wherein the PLC system is programmed in a digital signal processor.

12. The PLC system of claim 6, wherein the PLC system is included in an Advanced Audio Coding (AAC) codec implemented by software running on a microprocessor or digital signal processor in a portable electronic device configured to store or render audio signals.

13. A non-transitory, computer-readable storage medium having instructions stored thereon, which, when executed by an audio processor, causes the audio processor to perform operations comprising:

receiving, by an audio processor, a packet including a set of modified discrete cosine transform (MDCT) coefficients associated with a frame that includes time-domain samples of an audio signal;

determining, by the audio processor, that the received packet includes one or more errors;

generating, by the audio processor, estimated MDCT coefficients to replace the received set of MDCT coefficients, the estimated MDCT coefficients being based on corresponding MDCT coefficients associated with a last received packet that directly precedes the received packet in a sequence of packets;

assigning, by the audio processor, signs to a first subset of the estimated MDCT coefficients to be equal to corresponding signs of the corresponding MDCT coefficients of the last received packet, the first subset of estimated MDCT coefficients being associated with tonal bands of the last received packet;

randomly assigning, by the audio processor, signs to a second subset of the estimated MDCT coefficients, wherein the second subset of estimated MDCT coefficients are associated with non-tonal bands of the last received packet;

generating, by the audio processor, a concealment packet based on the set of estimated MDCT coefficients; and replacing, by the audio processor, the received packet with the concealment packet.

14. The non-transitory, computer-readable storage medium of claim 13, wherein the operations further comprise:

determining, by the audio processor, whether the MDCT coefficients are associated with the tonal bands or the non-tonal bands by comparing the MDCT coefficients with an energy threshold associated with the last received packet.

15. The non-transitory, computer-readable storage medium of claim 13, wherein the estimated MDCT coefficients are set equal to the corresponding MDCT coefficients of the last received packet.

16. The non-transitory, computer-readable storage medium of claim 13, wherein the operations further comprise:

generating, by the audio processor, an intermediate frame including windowed time-domain aliased samples from the concealment frame by means of an inverse MDCT (IMDCT); and modifying, by the audio processor, the windowed time-domain aliased samples of the intermediate frame based on the windowed time-domain samples of the audio signal.

17. The non-transitory, computer-readable storage medium of claim 13, wherein the operations further comprise:

generating, by the audio processor, an estimated decoded frame by adding a first half of the generated intermediate frame to a second half of a previously generated intermediate frame comprising windowed time-domain aliased samples associated with the last received packet.

* * * * *